US011661771B2

(12) United States Patent
Lammers et al.

(10) Patent No.: US 11,661,771 B2
(45) Date of Patent: May 30, 2023

(54) ELECTRONIC DRIVE FOR DOOR LOCKS

(71) Applicant: Amesbury Group, Inc., Amesbury, MA (US)

(72) Inventors: Tracy Lammers, Sioux Falls, SD (US); Douglas John Criddle, Sioux Falls, SD (US)

(73) Assignee: Amesbury Group, Inc., Edina, MN (US)

( * ) Notice: Subject to any disclaimer, the term of this patent is extended or adjusted under 35 U.S.C. 154(b) by 620 days.

(21) Appl. No.: 16/681,005

(22) Filed: Nov. 12, 2019

(65) Prior Publication Data

US 2020/0149327 A1 May 14, 2020

Related U.S. Application Data

(60) Provisional application No. 62/851,961, filed on May 23, 2019, provisional application No. 62/760,150, filed on Nov. 13, 2018.

(51) Int. Cl.
*E05C 1/00* (2006.01)
*E05B 17/00* (2006.01)

(52) U.S. Cl.
CPC ..... *E05C 1/006* (2013.01); *E05B 17/0029* (2013.01)

(58) Field of Classification Search
CPC ..... E05B 17/0029; E05B 47/0001; E05B 47/0012; E05B 2047/0014; E05B 2047/0015; E05B 2047/0016; E05B 2047/0022; E05B 2047/0026;
(Continued)

(56) References Cited

U.S. PATENT DOCUMENTS 333,093 A 12/1885 Wright
419,384 A 1/1890 Towne
651,947 A 6/1900 Johnson
(Continued)

FOREIGN PATENT DOCUMENTS

AU 84928 12/2020
CA 2631521 11/2009
(Continued)

OTHER PUBLICATIONS

"Intercity Locks—For All Your Security Needs—Fast", http://www.directlocks.co.uk/locks-multipoint-locks-c-123_96.html, accessed Oct. 27, 2011, original publication date unknown, 3 pgs.
(Continued)

*Primary Examiner* — David R Hare
*Assistant Examiner* — Emily G. Brown
(74) *Attorney, Agent, or Firm* — Merchant & Gould P.C.

(57) ABSTRACT

An electronic drive for a lock assembly includes a housing, a motor disposed within the housing, and at least one link bar coupled to the motor. The at least one link bar at least partially extends out of the housing. The electronic drive also includes a driven disk coupled to a first end of the at least one link bar and rotatable about a rotational axis. The driven disk is adapted to couple to the lock assembly, and upon rotation, extend and retract at least one locking element. In operation, the motor selectively drives substantially linear movement of the at least one link bar to rotate the driven disk about the rotational axis.

15 Claims, 12 Drawing Sheets

(58) Field of Classification Search
CPC .. E05B 2047/003; E05C 1/006; Y10S 292/46; Y10T 70/7113; Y10T 70/5823
USPC ..... 292/137, 144
See application file for complete search history.

(56) References Cited

U.S. PATENT DOCUMENTS 738,280 A 9/1903 Bell et al.
932,330 A 8/1909 Rotchford
958,880 A 5/1910 Lawson
966,208 A 8/1910 Hoes
972,769 A 10/1910 Lark
980,131 A 12/1910 Shean
998,642 A 7/1911 Shean
1,075,914 A 10/1913 Hoes
1,094,143 A 4/1914 Hagstrom
1,142,463 A 6/1915 Shepherd
1,174,652 A 3/1916 Banks
1,247,052 A 11/1917 Wilson
1,251,467 A 1/1918 Blixt et al.
1,277,174 A 8/1918 Bakst
1,359,347 A 11/1920 Fleisher
1,366,909 A 2/1921 Frommer
1,368,141 A 2/1921 Hagstrom
1,529,085 A 3/1925 Preble
1,574,023 A 2/1926 Crompton et al.
1,596,992 A 8/1926 Ognowicz
1,646,674 A 10/1927 Angelillo
1,666,654 A 4/1928 Hiering
1,716,113 A 6/1929 Carlson
1,974,253 A 9/1934 Sandor
2,535,947 A 12/1950 Newell
2,729,089 A 1/1956 Pelcin
2,739,002 A 3/1956 Johnson
2,862,750 A 12/1958 Minke
2,887,336 A 5/1959 Meyer
2,905,493 A 9/1959 Tocchetto
3,064,462 A 11/1962 Ng et al.
3,083,560 A 4/1963 Scott
3,124,378 A 3/1964 Jackson
3,157,042 A * 11/1964 Wolz ..... E05B 47/0012 70/279.1
3,162,472 A 12/1964 Rust
3,214,947 A 11/1965 Wikkerink
3,250,100 A 5/1966 Cornaro
3,332,182 A 7/1967 Mark
3,378,290 A 4/1968 Sekulich
3,413,025 A 11/1968 Sperry
3,437,364 A 4/1969 Walters
RE26,677 E 10/1969 Russell et al.
3,498,657 A 3/1970 Giampiero
3,578,368 A 5/1971 Dupuis
3,586,360 A 6/1971 Perrotta
3,617,080 A 11/1971 Miller
3,670,537 A 6/1972 Horgan, Jr.
3,792,884 A 2/1974 Tutikawa
3,806,171 A 4/1974 Fernandez
3,899,201 A 8/1975 Paioletti
3,904,229 A 9/1975 Waldo
3,919,808 A 11/1975 Simmons
3,933,382 A 1/1976 Counts
3,940,886 A 3/1976 Ellingson, Jr.
3,953,061 A 4/1976 Hansen et al.
4,076,289 A 2/1978 Fellows et al.
4,116,479 A 9/1978 Poe
4,130,306 A 12/1978 Brkic
4,132,438 A 1/1979 Guymer
4,135,377 A 1/1979 Kleefeldt
4,146,994 A 4/1979 Williams
4,236,396 A 12/1980 Surko et al.
4,273,368 A 6/1981 Tanaka
4,283,882 A 8/1981 Hubbard
4,288,944 A 9/1981 Donovan
4,362,328 A 12/1982 Tacheny
4,365,490 A 12/1982 Manzoni
4,372,594 A 2/1983 Gater
4,476,700 A 10/1984 King
4,500,122 A 2/1985 Douglas
4,547,006 A 10/1985 Castanier
4,548,432 A 10/1985 Bengtsson
4,593,542 A 6/1986 Rotondi et al.
4,595,220 A 6/1986 Hatchett, Jr.
4,602,490 A 7/1986 Glass
4,602,812 A 7/1986 Bourner
4,607,510 A 8/1986 Shanaan et al.
4,633,688 A 1/1987 Beudat
4,639,025 A 1/1987 Fann
4,643,005 A 2/1987 Logas
4,691,543 A 9/1987 Watts
4,704,880 A 11/1987 Schlindwein
4,706,512 A * 11/1987 McKernon ..... H02K 23/68 74/411
4,717,909 A 1/1988 Davis
4,754,624 A 7/1988 Fleming et al.
4,768,817 A 9/1988 Fann
4,799,719 A 1/1989 Wood
4,893,849 A 1/1990 Schlack
4,913,475 A * 4/1990 Bushnell ..... E05B 55/00 292/144
4,949,563 A 8/1990 Gerard et al.
4,961,602 A 10/1990 Pettersson
4,962,653 A 10/1990 Kaup
4,962,800 A 10/1990 Owiriwo
4,964,660 A 10/1990 Prevot et al.
4,973,091 A 11/1990 Paulson
5,077,992 A 1/1992 Su
5,092,144 A 3/1992 Fleming et al.
5,114,192 A 5/1992 Toledo
5,118,151 A 6/1992 Nicholas, Jr. et al.
5,125,703 A 6/1992 Clancy et al.
5,148,691 A 9/1992 Wallden
5,171,050 A 12/1992 Mascotte
5,172,944 A 12/1992 Munich et al.
5,184,852 A 2/1993 O'Brien
5,193,861 A 3/1993 Juga
5,197,771 A 3/1993 Kaup et al.
5,257,841 A 11/1993 Geringer
5,265,452 A 11/1993 Dawson et al.
5,290,077 A 3/1994 Fleming
5,364,138 A 11/1994 Dietrich
5,373,716 A 12/1994 MacNeil et al.
5,382,060 A 1/1995 O'Toole et al.
5,388,875 A 2/1995 Fleming
5,394,718 A * 3/1995 Hotzl ..... E05B 47/0012 292/144
5,404,737 A 4/1995 Hotzl
5,441,315 A 8/1995 Kleefeldt
5,456,503 A 10/1995 Russell et al.
5,482,334 A 1/1996 Hotzl
5,495,731 A 3/1996 Riznik
5,496,082 A 3/1996 Zuckerman
5,498,038 A 3/1996 Simon
5,513,505 A 5/1996 Danes
5,516,160 A 5/1996 Kajuch
5,524,941 A 6/1996 Fleming
5,524,942 A 6/1996 Fleming
5,531,086 A * 7/1996 Bryant ..... E05B 63/0004 70/279.1
5,544,924 A 8/1996 Paster
5,546,777 A 8/1996 Liu
5,603,534 A 2/1997 Fuller
5,609,372 A 3/1997 Ponelle
5,620,216 A 4/1997 Fuller
5,628,216 A 5/1997 Qureshi
5,707,090 A 1/1998 Sedley
5,716,154 A 2/1998 Miller et al.
5,722,704 A 3/1998 Chaput et al.
5,728,108 A 3/1998 Griffiths et al.
5,735,559 A 4/1998 Frolov
5,757,269 A 5/1998 Roth
5,782,114 A 7/1998 Zeus et al.
5,791,179 A 8/1998 Brask
5,791,700 A 8/1998 Biro
5,820,170 A 10/1998 Clancy

(56) References Cited

U.S. PATENT DOCUMENTS 5,820,173 A 10/1998 Fuller
5,825,288 A 10/1998 Wojdan
5,865,479 A 2/1999 Viney
5,878,606 A 3/1999 Chaput et al.
5,890,753 A 4/1999 Fuller
5,896,763 A 4/1999 Dinkelborg et al.
5,901,989 A 5/1999 Becken et al.
5,906,403 A 5/1999 Bestler et al.
5,911,460 A 6/1999 Hawkins
5,911,763 A 6/1999 Quesada
5,915,764 A 6/1999 MacDonald
5,918,916 A 7/1999 Kajuch
5,931,430 A 8/1999 Palmer
5,946,956 A 9/1999 Hotzl
5,951,068 A 9/1999 Strong et al.
5,979,199 A 11/1999 Elpern
6,050,115 A 4/2000 Schroter et al.
6,079,585 A 6/2000 Lentini
6,089,058 A 7/2000 Elpern
6,094,869 A 8/2000 Magoon et al.
6,098,433 A 8/2000 Manaici
6,112,563 A * 9/2000 Ramos ..... G07C 9/00182 292/144
6,116,067 A 9/2000 Myers
6,119,538 A 9/2000 Chang
6,120,071 A 9/2000 Picard
D433,916 S 11/2000 Frey
6,145,353 A * 11/2000 Doucet ..... E05B 47/0692 70/277
6,147,622 A * 11/2000 Fonea ..... E05B 47/0642 340/5.2
6,148,650 A 11/2000 Kibble
6,174,004 B1 1/2001 Picard et al.
6,196,599 B1 3/2001 D'Hooge
6,209,931 B1 4/2001 Von Stoutenborough et al.
6,217,087 B1 4/2001 Fuller
6,250,842 B1 6/2001 Kruger
6,257,030 B1 7/2001 Davis, III et al.
6,264,252 B1 7/2001 Clancy
6,266,981 B1 7/2001 von Resch et al.
6,282,929 B1 9/2001 Eller et al.
6,283,516 B1 9/2001 Viney
6,293,598 B1 9/2001 Rusiana
6,318,769 B1 11/2001 Kang
6,327,881 B1 12/2001 Grundler et al.
6,389,855 B2 5/2002 Renz et al.
6,441,735 B1 8/2002 Marko
6,443,506 B1 9/2002 Su
6,453,616 B1 9/2002 Wright
6,454,322 B1 * 9/2002 Su ..... E05B 59/00 70/462
6,457,751 B1 10/2002 Hartman
6,490,895 B1 12/2002 Weinerman
6,502,435 B2 1/2003 Watts et al.
6,516,641 B1 2/2003 Segawa
6,517,127 B1 * 2/2003 Lu ..... E05B 47/0012 292/144
6,540,268 B2 4/2003 Pauser
6,564,596 B2 5/2003 Huang
6,568,726 B1 5/2003 Caspi
6,580,355 B1 6/2003 Milo
6,619,085 B1 9/2003 Hsieh
6,637,784 B1 10/2003 Hauber
6,672,632 B1 1/2004 Speed et al.
6,688,656 B1 2/2004 Becken
6,725,693 B2 * 4/2004 Yu ..... E05B 47/068 292/144
6,733,051 B1 5/2004 Cowper
6,776,441 B2 8/2004 Liu
6,810,699 B2 11/2004 Nagy
6,813,916 B2 11/2004 Chang
6,871,451 B2 3/2005 Harger et al.
6,905,152 B1 6/2005 Hudson
6,929,293 B2 8/2005 Tonges
6,935,662 B1 8/2005 Hauber et al.
6,945,572 B1 * 9/2005 Hauber ..... E05B 65/0811 70/95
6,962,377 B2 11/2005 Tonges
6,971,686 B2 12/2005 Becken
6,994,383 B2 2/2006 Morris
7,000,959 B2 2/2006 Sanders
7,010,945 B2 3/2006 Yu
7,010,947 B2 3/2006 Milo
7,025,394 B1 4/2006 Hunt
7,032,418 B2 4/2006 Martin
7,052,054 B2 5/2006 Luker
7,083,206 B1 8/2006 Johnson
7,128,350 B2 10/2006 Eckerdt
7,152,441 B2 12/2006 Friar
7,155,946 B2 1/2007 Lee et al.
7,203,445 B2 4/2007 Uchida
7,207,199 B2 4/2007 Smith et al.
7,249,791 B2 7/2007 Johnson
7,261,330 B1 8/2007 Hauber
7,353,637 B2 4/2008 Harger et al.
7,404,306 B2 7/2008 Walls et al.
7,410,194 B2 8/2008 Chen
7,418,845 B2 9/2008 Timothy
7,513,540 B2 4/2009 Hagemeyer et al.
7,526,933 B2 5/2009 Meekma
7,634,928 B2 12/2009 Hunt
7,637,540 B2 12/2009 Chiang
7,677,067 B2 3/2010 Riznik et al.
7,686,207 B1 3/2010 Jeffs
7,707,862 B2 5/2010 Walls et al.
7,726,705 B2 6/2010 Kim
7,735,882 B2 6/2010 Abdollahzadeh et al.
7,748,759 B2 7/2010 Chen
7,856,856 B2 12/2010 Shvartz
7,878,034 B2 2/2011 Alber et al.
7,946,080 B2 5/2011 Ellerton
7,963,573 B2 6/2011 Blomqvist
8,079,240 B2 * 12/2011 Brown ..... E05B 47/0676 70/279.1
8,161,780 B1 4/2012 Huml
8,182,002 B2 5/2012 Fleming
8,325,039 B2 12/2012 Picard
8,348,308 B2 1/2013 Hagemeyer et al.
8,376,414 B2 2/2013 Nakanishi et al.
8,376,415 B2 2/2013 Uyeda
8,382,166 B2 2/2013 Hagemeyer et al.
8,382,168 B2 2/2013 Carabalona
8,398,126 B2 3/2013 Nakanishi et al.
8,403,376 B2 3/2013 Greiner
8,494,680 B2 7/2013 Sparenberg et al.
8,550,506 B2 10/2013 Nakanishi
8,567,631 B2 10/2013 Brunner
8,628,126 B2 1/2014 Hagemeyer et al.
8,646,816 B2 2/2014 Dziurdzia
8,839,562 B2 9/2014 Madrid
8,840,153 B2 9/2014 Juha
8,850,744 B2 10/2014 Bauman et al.
8,851,532 B2 10/2014 Gerninger
8,876,172 B2 11/2014 Denison
8,899,635 B2 12/2014 Nakanishi
8,922,370 B2 12/2014 Picard
8,939,474 B2 1/2015 Hagemeyer et al.
9,428,937 B2 8/2016 Tagtow et al.
9,482,035 B2 * 11/2016 Wolf ..... E05B 65/08
9,512,654 B2 12/2016 Armari et al.
9,605,444 B2 3/2017 Rickenbaugh
9,637,957 B2 5/2017 Hagemeyer et al.
9,758,997 B2 9/2017 Hagemeyer et al.
9,765,550 B2 9/2017 Hemmingsen et al.
9,790,716 B2 10/2017 Hagemeyer et al.
9,822,552 B2 11/2017 Eller et al.
10,087,656 B1 10/2018 Cannella
10,174,522 B2 1/2019 Denison
10,240,366 B2 3/2019 Sotes Delgado
10,246,914 B2 4/2019 Sieglaar
10,273,718 B2 4/2019 Cannella
10,400,477 B2 9/2019 Moon
10,487,544 B2 11/2019 Ainley

(56) References Cited

U.S. PATENT DOCUMENTS 10,662,675 B2 5/2020 Tagtow
10,738,506 B2 8/2020 Holmes
10,808,424 B2 10/2020 Criddle
10,822,836 B2 11/2020 Nakasone
10,968,661 B2 4/2021 Tagtow
11,021,892 B2 6/2021 Tagtow
11,441,333 B2 9/2022 Tagtow
2002/0104339 A1 8/2002 Saner
2003/0024288 A1 2/2003 Gokcebay et al.
2003/0159478 A1 8/2003 Nagy
2004/0003633 A1* 1/2004 Alexander ..... G07C 9/00563 70/277
2004/0004360 A1 1/2004 Huang
2004/0011094 A1 1/2004 Hsieh
2004/0066046 A1 4/2004 Becken
2004/0089037 A1 5/2004 Chang
2004/0107746 A1 6/2004 Chang
2004/0107747 A1 6/2004 Chang
2004/0112100 A1 6/2004 Martin
2004/0145189 A1 7/2004 Liu
2004/0227349 A1 11/2004 Denys
2004/0239121 A1 12/2004 Morris
2005/0029345 A1 2/2005 Waterhouse
2005/0044908 A1 3/2005 Min
2005/0050928 A1 3/2005 Frolov
2005/0103066 A1 5/2005 Botha et al.
2005/0144848 A1 7/2005 Harger et al.
2005/0166647 A1 8/2005 Walls
2005/0180562 A1 8/2005 Chiang
2005/0229657 A1 10/2005 Johansson et al.
2006/0043742 A1 3/2006 Huang
2006/0071478 A1 4/2006 Denys
2006/0076783 A1 4/2006 Tsai
2006/0150516 A1 7/2006 Hagemeyer
2006/0208509 A1 9/2006 Bodily
2007/0068205 A1 3/2007 Timothy
2007/0080541 A1 4/2007 Fleming
2007/0113603 A1 5/2007 Polster
2007/0170725 A1 7/2007 Speyer et al.
2007/0259551 A1 11/2007 Rebel
2008/0000276 A1 1/2008 Huang
2008/0001413 A1 1/2008 Lake
2008/0087052 A1 4/2008 Abdollahzadeh et al.
2008/0092606 A1 4/2008 Meekma
2008/0093110 A1 4/2008 Bagung
2008/0141740 A1 6/2008 Shvartz
2008/0150300 A1 6/2008 Harger et al.
2008/0156048 A1 7/2008 Topfer
2008/0156049 A1 7/2008 Topfer
2008/0157544 A1 7/2008 Phipps
2008/0178530 A1 7/2008 Ellerton et al.
2008/0179893 A1 7/2008 Johnson
2008/0184749 A1 8/2008 Alber et al.
2008/0191499 A1 8/2008 Stein
2009/0064737 A1 3/2009 Fan
2009/0078011 A1 3/2009 Avni
2009/0218832 A1 9/2009 Mackle
2009/0314042 A1 12/2009 Fan
2009/0315669 A1 12/2009 Lang
2010/0107707 A1 5/2010 Viviano
2010/0154490 A1 6/2010 Hagemeyer et al.
2010/0213724 A1 8/2010 Uyeda
2010/0236302 A1 9/2010 Uyeda
2010/0313612 A1 12/2010 Eichenstein
2010/0327610 A1 12/2010 Nakanishi et al.
2011/0056254 A1 3/2011 Tsai
2011/0198867 A1 8/2011 Hagemeyer et al.
2011/0289987 A1 12/2011 Chiou et al.
2011/0314877 A1 12/2011 Fang
2012/0001443 A1 1/2012 Mitchell
2012/0146346 A1 6/2012 Hagemeyer et al.
2012/0235428 A1 9/2012 Blacklaws et al.
2012/0306220 A1 12/2012 Hagemeyer et al.
2013/0019643 A1 1/2013 Tagtow et al.
2013/0081251 A1 4/2013 Hultberg
2013/0140833 A1 6/2013 Hagemeyer et al.
2013/0152647 A1 6/2013 Terei et al.
2013/0176107 A1* 7/2013 Dumas ..... G07C 9/00571 340/5.61
2013/0200636 A1 8/2013 Hagemeyer et al.
2013/0234449 A1 9/2013 Dery et al.
2013/0276488 A1 10/2013 Haber
2014/0060127 A1 3/2014 Hemmingsen et al.
2014/0125068 A1 5/2014 Hagemeyer et al.
2014/0159387 A1 6/2014 Hagemeyer et al.
2014/0182343 A1 7/2014 Talpe
2014/0367978 A1 12/2014 Geringer
2015/0075233 A1 3/2015 Pluta
2015/0089804 A1 4/2015 Picard
2015/0114176 A1* 4/2015 Bisang ..... E05F 3/104 74/665 A
2015/0170449 A1 6/2015 Chandler, Jr.
2015/0176311 A1 6/2015 Picard
2015/0252595 A1 9/2015 Hagemeyer et al.
2016/0083976 A1 3/2016 Rickenbaugh
2016/0094103 A1 3/2016 Lien
2016/0108650 A1 4/2016 Hagemeyer et al.
2016/0369525 A1 12/2016 Tagtow et al.
2018/0023320 A1 1/2018 McKibben
2018/0051478 A1 2/2018 Tagtow
2018/0051480 A1 2/2018 Tagtow
2018/0119462 A1 5/2018 Hagemeyer
2018/0155962 A1 6/2018 Mitchell et al.
2018/0298642 A1 10/2018 Tagtow
2018/0313116 A1 11/2018 Criddle
2019/0024437 A1 1/2019 Tagtow
2019/0032368 A1* 1/2019 Welbig ..... G07C 9/00182
2019/0277062 A1 9/2019 Tagtow
2020/0141155 A1 5/2020 Lammers
2020/0354990 A1 11/2020 Tagtow
2020/0370338 A1 11/2020 Holmes

FOREIGN PATENT DOCUMENTS

CN 1243908 2/2000
CN 2554288 Y 6/2003
CN 2595957 Y 12/2003
CN 2660061 12/2004
CN 201031548 Y 3/2008
CN 202047652 U 11/2011
DE 1002656 2/1957
DE 1584112 9/1969
DE 2639065 3/1977
DE 3032086 3/1982
DE 3836693 5/1990
DE 9011216 10/1990
DE 4224909 2/1993
DE 29807860 8/1998
DE 20115378 U1 11/2001
DE 10253240 5/2004
DE 202012002743 U1 4/2012
DE 202013000920 U1 4/2013
DE 202013000921 U1 4/2013
DE 202013001328 U1 5/2013
EP 0007397 A1 2/1980
EP 0231042 A2 8/1987
EP 0268750 6/1988
EP 341173 11/1989
EP 359284 3/1990
EP 661409 7/1995
EP 792987 9/1997
EP 1106761 6/2001
EP 1283318 2/2003
EP 1449994 8/2004
EP 1574642 9/2005
EP 1867817 12/2007
EP 2128362 12/2009
EP 2273046 A2 1/2011
EP 2339099 A1 6/2011
EP 2450509 5/2012
EP 2581531 A1 4/2013
EP 2584123 A1 4/2013
EP 2584124 A2 4/2013
EP 2998483 3/2016

(56) References Cited

FOREIGN PATENT DOCUMENTS

| | | | |
|---|---|---|---|
| EP | 3091152 | A1 | 11/2016 |
| FR | 363424 | | 7/1906 |
| FR | 370890 | | 2/1907 |
| FR | 21883 | E | 4/1921 |
| FR | 1142316 | | 3/1957 |
| FR | 1162406 | A | 9/1958 |
| FR | 1201087 | | 12/1959 |
| FR | 2339723 | | 9/1977 |
| FR | 2342390 | | 9/1977 |
| FR | 2344695 | | 10/1977 |
| FR | 2502673 | | 10/1982 |
| FR | 2848593 | | 2/2005 |
| FR | 3017641 | | 8/2015 |
| GB | 226170 | | 4/1925 |
| GB | 264373 | A | 1/1927 |
| GB | 583655 | | 12/1946 |
| GB | 612094 | A | 11/1948 |
| GB | 1498849 | | 1/1978 |
| GB | 1575900 | | 10/1980 |
| GB | 2051214 | | 1/1981 |
| GB | 2076879 | | 12/1981 |
| GB | 2115055 | A | 9/1983 |
| GB | 2122244 | | 1/1984 |
| GB | 2126644 | | 3/1984 |
| GB | 2134170 | | 8/1984 |
| GB | 2136045 | | 9/1984 |
| GB | 2168747 | | 6/1986 |
| GB | 2196375 | | 4/1988 |
| GB | 2212849 | | 8/1989 |
| GB | 2225052 | | 5/1990 |
| GB | 2230294 | | 10/1990 |
| GB | 2242702 | | 10/1991 |
| GB | 2244512 | | 12/1991 |
| GB | 2265935 | | 10/1993 |
| GB | 2270343 | | 3/1994 |
| GB | 2280474 | | 2/1995 |
| GB | 2318382 | A | 4/1998 |
| GB | 2364545 | | 1/2002 |
| GB | 2496911 | A | 5/2013 |
| IT | 614960 | | 1/1961 |
| JP | 64-083777 | | 3/1989 |
| JP | 2003343141 | | 12/2003 |
| JP | 2006112042 | | 4/2006 |
| JP | 2008002203 | | 1/2008 |
| KR | 2011094706 | | 8/2011 |
| NL | 8105627 | | 7/1983 |
| SE | 309372 | | 3/1969 |
| WO | 96/25576 | | 8/1996 |
| WO | 97/41323 | | 11/1997 |
| WO | 02/33202 | | 4/2002 |
| WO | 2007/104499 | | 9/2007 |
| WO | 2009/059112 | | 5/2009 |
| WO | 2010071886 | | 6/2010 |
| WO | 2015/079290 | | 6/2015 |
| WO | 2020/023652 | | 1/2020 |

OTHER PUBLICATIONS

"Intercity Locks—For All Your Security Needs—Fast", http://www.directlocks.co.uk/locks-multipoint-locks-c-123_96.html?page=2&sort=2A, accessed Oct. 27, 2011, original publication date unknown, 3 pgs.

"Intercity Locks—For All Your Security Needs—Fast", http://www.directlocks.co.uk/locks-multipoint-locks-c-123_96.html?page=3&sort=2A, accessed Oct. 27, 2011, original publication date unknown, 3 pgs.

"LocksOnline.co.uk: Premier Supplier of Security Products", http://www.locksonline.co.uk/acatalog/Maco_multipoint_lock_2_cams_2_shootbolt_attachment.html, accessed Oct. 27, 2011, original publication date unknown, 5 pgs.

"LocksOnline.co.uk: Premier Supplier of Security Products", http://www.locksonline.co.uk/acatalog/upvc_Locks.html, accessed Oct. 27, 2011, original publication date unknown, 6 pgs.

"UPVC Window Hardware and uPVC Door Hardware online", http://www.upvc-hardware.co.uk/, accessed Oct. 27, 2011, original publication date unknown, 2 pgs.

Doorking.com—Electric Locks—Strikes and Deadbolts; printed from https://www.doorking.com/access-control/electricocks-strikes-deadbolts, 2 pages, Feb. 2016.

magneticlocks.net—Electric Strikes and Deadbolts; printed from https://www.magneticlocks.net/electric-strikes-and-deadbolts/electric-strikes.html, 8 pages, Feb. 2016.

sdcsecurity.com—Latch and Deadbolt Monitoring Strikes; printed from http://www.sdcsecurity.com/monitor-strike-kits2.htm, 2 pages, Feb. 2016.

* cited by examiner

ELECTRONIC DRIVE FOR DOOR LOCKS

CROSS-REFERENCE TO RELATED APPLICATIONS

This application claims priority to and the benefit of U.S. Provisional Patent Application No. 62/760,150, filed Nov. 13, 2018, and U.S. Provisional Patent Application No. 62/851,961, filed May 23, 2019, the disclosures of which are hereby incorporated by reference herein in their entirety.

INTRODUCTION

Doors commonly utilize locking devices on the locking stile that engage keepers mounted on the jamb frame to provide environmental control and security, and to prevent unintentional opening of the doors. Projecting handles, interior thumb-turns, and exterior key cylinders are commonly used devices to manually actuate the locking devices between locked and unlocked conditions and may also be used as a handgrip to slide the door open or closed.

SUMMARY

In an aspect, the technology relates to an electronic drive for a lock assembly including: a housing; a motor disposed within the housing; at least one link bar coupled to the motor and at least partially extending out of the housing; and a driven disk coupled to a first end of the at least one link bar and rotatable about a rotational axis, wherein the driven disk is adapted to couple to the lock assembly, and upon rotation, extend and retract at least one locking element, and wherein in operation, the motor selectively drives substantially linear movement of the at least one link bar to rotate the driven disk about the rotational axis.

In an example, a clutch assembly is coupled to a second end of the at least one link bar and disposed within the housing, wherein the rotational axis is a first rotational axis and the clutch assembly is rotatable about a second rotational axis. In another example, the housing defines a longitudinal axis, wherein the first rotational axis is parallel to and offset from the second rotational axis, and wherein the first rotational axis and the second rotational axis are both substantially orthogonal to the longitudinal axis. In yet another example, a worm drive is coupled between the motor and the clutch assembly. In still another example, the worm drive is selectively engageable with the clutch assembly. In an example, the worm drive is at least partially rotatable independently from the clutch assembly.

In another example, the clutch assembly is at least partially rotatable independently from the worm drive. In yet another example, the clutch assembly includes two disks coupled together by a tension system. In still another example, upon exceeding a predetermined load value, the two disks of the clutch assembly are independently rotatable. In an example, the electronic drive further includes a position sensor for determining a relative position of the clutch assembly. In another example, the position sensor is a mechanical switch. In yet another example, when the clutch assembly rotates about the second rotational axis, the corresponding rotation of the driven disk is in the same rotational direction. In still another example, the electronic drive further includes an access system remote from the housing, wherein the access system controls operation of the motor.

In another aspect, the technology relates to a door lock including: a mortise lock assembly including one or more locking elements; and an electronic drive coupled to the mortise lock assembly to extend and retract the one or more locking elements, wherein the electronic drive includes: a housing; a motor disposed within the housing; at least one link bar coupled to the motor and at least partially extending out of the housing; and a driven disk coupled to a first end of the at least one link bar and rotatable about a rotational axis, wherein the driven disk is coupled to the mortise lock assembly, and upon rotation, extend and retract the one or more locking elements, and wherein in operation, the motor selectively drives substantially linear movement of the at least one link bar to rotate the driven disk about the rotational axis.

In an example, the door lock further includes a faceplate, wherein the mortise lock assembly and the housing are both coupled to the faceplate. In another example, a thumbturn and/or a key cylinder is coupled to the driven disk. In yet another example, an access system is operatively coupled to the electronic drive and selectively drives operation of the motor.

In another aspect, the technology relates to a method of operating a lock assembly including: receiving at an access system an activation signal from a control element; detecting, by the access system, a presence of a security device relative to a door; determining, by the access system, a position of the security device relative to the door; determining, by the access system, an authorization of the security device; and rotating a driven disk coupled to the lock assembly based on the security device being (i) positioned proximate the door; (ii) located exterior to the door; and (iii) authorized to operate the access system, wherein the driven disk is coupled to a motor that drives rotation of the driven disk.

In an example, rotating the driven disk includes rotating a clutch assembly and substantially linearly moving a pair of link bars extending between the driven disk and the clutch assembly. In another example, after rotating the driven disk, positioning a worm drive coupled to the motor in a center neutral position.

BRIEF DESCRIPTION OF THE DRAWINGS

There are shown in the drawings, examples that are presently preferred, it being understood, however, that the technology is not limited to the precise arrangements and instrumentalities shown.

DETAILED DESCRIPTION

Figure 1:
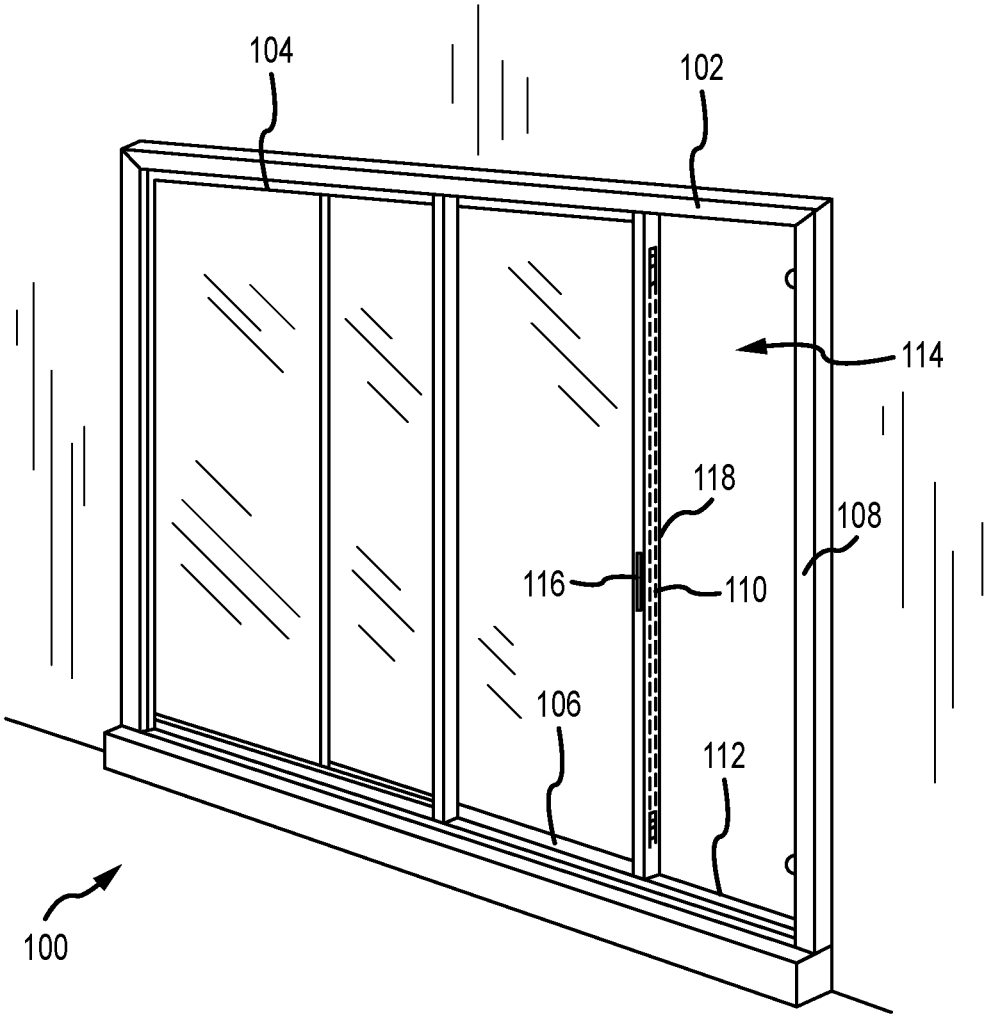
FIG. 1 is a perspective view of a sliding door assembly.

FIG. 1 is a perspective view of a sliding door assembly 100. In the example, the sliding door assembly 100 includes a frame 102, a fixed door panel 104, and a sliding door panel 106. The frame 102 includes a jamb 108 that the door panels 104, 106 are mounted within. The sliding door panel 106 includes a side stile 110, and is laterally slidable in tracks 112 to open and close an opening 114 defined by the frame 102. A handle assembly 116 and a lock assembly 118 are disposed on the side stile 110 and enable the sliding door panel 106 to be locked and unlocked from an exterior side and/or an interior side of the door. For example, the handle assembly 116 includes a thumbturn (not shown) and/or a key cylinder (not shown) that are coupled to the lock assembly 118 and enable locking members therein to be extended and/or retracted.

As described herein, an electronic drive may be coupled to the handle assembly 116 and/or the lock assembly 118 and enable remote and/or automatic locking and unlocking of the sliding door panel 106 without use of the thumbturn or key cylinder. The electronic drive is configured to be mounted within any number of door panel thickness, for example, panel thickness as small as 1½ inches, although other panel thickness are also contemplated herein. Additionally, the electronic drive may be coupled to any number of different types of lock assemblies 118 so it is adaptable to existing designs as a retrofit, as well as new designs as they come on the market. Accordingly, as home and commercial electronic lock systems are ever increasingly implemented and utilized, a single electronic drive may be used across a wide variety of door types and lock assembly types.

Figure 2A:
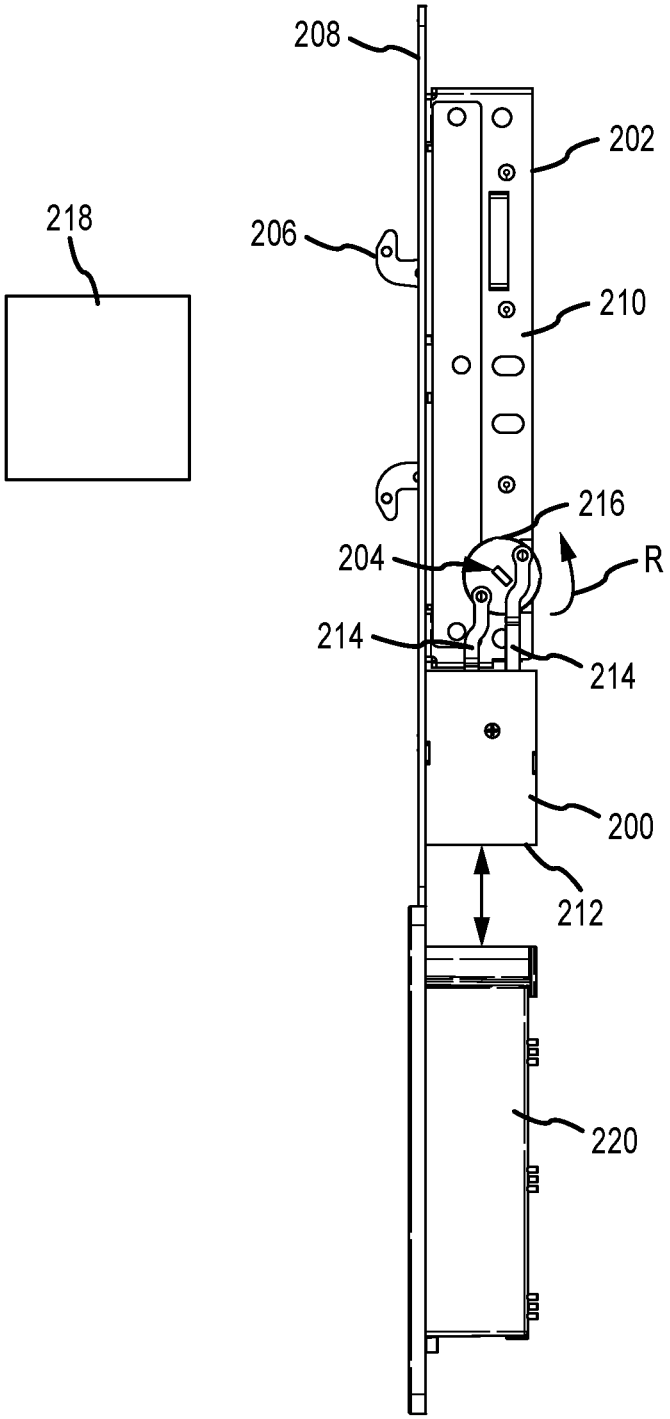
FIG. 2A is a side view of an electronic drive coupled to a lock assembly for use with the sliding door assembly of FIG. 1.
Figure 2B:
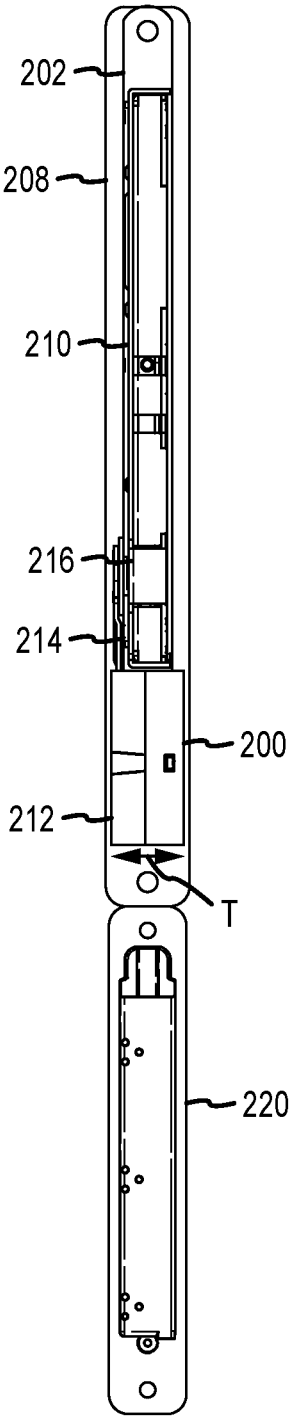
FIG. 2B is a rear view of the electronic drive coupled to the lock assembly.

FIG. 2A is a side view of an electronic drive 200 coupled to a lock assembly 202 for use with the sliding door assembly 100 (shown in FIG. 1). FIG. 2B is a rear view of the electronic drive 200 coupled to the lock assembly 202. Referring concurrently to FIGS. 2A and 2B, the lock assembly 202 is a mortise-style door lock that is known in the art. That is, the lock assembly 202 is configured to couple to a rotatable thumbturn (not shown) and/or key cylinder (not shown) at a drive tail opening 204 so that rotation of the thumbturn or key cylinder rotates a component of the lock assembly 202 that extends and/or retracts locking elements 206 from a housing 210. This allows the locking elements 206 to extend and retract through a faceplate 208. In the example, the lock assembly 202 is AmesburyTruth's Nexus Series mortise lock that is a two-point or a multi-point lockset for sliding doors. In other examples, the lock assembly 202 may be AmesburyTruth's Gemini Series two-point mortise lock or a single-point mortise lock such as AmesburyTruth's 537 series, 555 series, 597 series, 840 series, 957 series, 1326 series, 2310 series, 2320 series, and 2321 series lock sets. In still other examples, the lock assembly 202 may be AmesburyTruth's P3000 series multi-point lock system. It is to be appreciated that the electronic drive 200 may be used with any number of lock assemblies 202 (e.g., AmesburyTruth's lock sets described above, any other lock set, or any other lock set from other manufacturers) that actuate the locking element 206 via a rotating motion R of an actuator. All of AmesburyTruth's locks are available from AmesburyTruth™ of Sioux Falls, S. Dak., by Amesbury Group, Inc.

In the example, the electronic drive 200 is configured to couple to the lock assembly 202 and enable actuation of the lock assembly 202 without use of the traditional thumbturn or key cylinder. However, the electronic drive 200 still enables use of the thumbturn or key cylinder as required or desired, for example, it still enables a drive tail to extend into the opening 204 for actuation of the lock assembly 202. One challenge with the automation of door locks (e.g., providing an electronic motor for actuation thereof) is that doors are known to come in a wide variety of sizes (e.g., height, width, and thickness). As such, there are many known different styles and shapes of lock assemblies and designing for each and every different lock assembly with an electronic motor is undesirable. For example, one type of electronic motor configuration for a first lock assembly may not work in a second lock assembly because the door thickness is too small to accommodate the configuration. Additionally, with many different lock assembly configurations, the number of products and stock keeping units increase often exponentially, thereby decreasing manufacturing, shipping, and/or invoicing inefficiencies. Accordingly, the electronic drive 200 is configured to be used with many different types of lock assemblies 202 without significant or any changes thereto. This not only increases manufacturing efficiencies as existing mechanical door locks can still be used, but the electronic drive 200 enables for existing door locks to be upgraded with automated actuators as required or desired.

In the example, the electronic drive 200 includes a motor drive unit 212 with a pair of link bars 214 extending therefrom. The ends of the link bars 214 are coupled to a driven disk 216 that engages with the lock assembly 202 so the electronic drive 200 can actuate the lock assembly 202. In one example, the driven disk 216 directly couples to an actuator component of the lock assembly 202. In other examples, the driven disk 216 couples to the drive tail (not shown) of the thumbturn and or key cylinder such that the driven disk 216 drives movement thereof. In either configuration, the opening 204 of the lock assembly 202 is left unimpeded so that manual actuation of the lock assembly 202 may still occur via a drive tail extending therethrough. In the example, the faceplate 208 of the lock assembly 202 may be extended so that the motor drive unit 212 can be supported on the lock assembly 202. This enables the lock assembly 202 and the electronic drive 200 to be installed into the door as a single unit. In other examples, the motor drive unit 212 need not couple to the faceplate 208 of the lock assembly 202 and may include its own faceplate (not shown) so it can be mounted separately on the door. In the example, the electronic drive 200 can be positioned below the lock assembly 202 (as illustrated), or may be positioned above the lock assembly 202 as required or desired.

In operation, the lock assembly 202 can be operated from an interior side or an exterior side of the door by a handle assembly (e.g., the handle assembly 116 shown in FIG. 1). To unlock from the interior side, a thumbturn (not shown) may be coupled to the lock assembly 202 by a drive tail within the opening 204 so that rotational movement of the thumbturn may extend or retract the locking elements 206. In other examples, the thumbturn may be a thumb slide so that linear movement may induce corresponding rotation of the drive tail by a linkage system. To operate from the exterior side, a key rotating a key cylinder (not shown) may be coupled to the lock assembly 202 by a drive tail within the opening 204 so that rotational movement of the key cylinder may extend or retract the locking elements 206. One example of a handle assembly is described in U.S. patent application Ser. No. 16/045,161, filed Jul. 25, 2018, entitled "ACCESS HANDLE FOR SLIDING DOORS," and the disclosure of which is hereby incorporated by reference herein in its entirety.

Additionally or alternatively, the lock assembly 202 can be automatically actuated by the electronic drive 200. By including the electronic drive 200, the door is enabled to be locked and unlocked from either the exterior or interior side without use of a manual key within the key cylinder or the thumbturn. The electronic drive 200 is configured to motorize the locking and unlocking of the lock assembly 202 so that only a control element (e.g., a button or touch pad) needs to be actuated, thereby simplifying and automating door lock use for the user. Additionally, to provide security to the electronic drive 200, access control authentication for the control element may be provided by a security device 218 (shown in FIG. 2A). For example, the security device 218 may be a mobile device such as a phone or a key fob that can communicate with the electronic drive 200 by sending communication signals through wireless communication protocols (e.g., Bluetooth communication protocols). Accordingly, use of a physical key is no longer necessary to unlock the door. This enables multiple users (e.g., several members of a family) to each have access while reducing the risk of physical keys being lost or stolen. Additionally, controlled access (e.g., for one time access, a set number of uses, or a set day or time of day) can be set up so that users, such as dog walkers, house sitters, or cleaners, can have limited access through the door. Furthermore, records of who accessed the door and at what time may be compiled and/or stored.

The electronic drive 200 and the lock assembly 202 are configured to be mounted on a locking edge of the side stile. That is, the faceplate 208 is substantially flush with the surface of the door and the electronic drive 200 and the lock assembly 202 are at least partially recessed within the door. Since the electronic drive 200 can be used with any number of lock assemblies, as described in detail above, it is sized and shaped for use in a wide variety of door thicknesses. For example, the electronic drive 200 has a thickness T (shown in FIG. 2B) that is approximately 1 inch, and as such, it is enabled for use in narrower doors that are about 1½ inch thick. Generally, sliding doors are known to have thicknesses as small as 1½-1¾ inches, and for comparison, the access handle described in U.S. patent application Ser. No. 16/045,161, filed Jul. 25, 2018, requires at least a 2¼ inch thick door panel because of the configuration and orientation of the components therein. In order to use the electronic drive 200 for different lock assemblies 202, the length of the link bars 214 and the driven disk 216 are the only components that are required to be changed or modified so that various drive tail openings 204 of the lock assemblies 202 can be accommodated.

The electronic drive 200 may be battery operated or line voltage operated via the structure's power source as required or desired. In either configuration, an access system 220 may be electrically and/or communicatively coupled to the electronic drive 200 by wired or wireless protocols. For the battery operated configuration, the power supply (e.g., 4 AA batteries) may be disposed within the access system 220. In the example, the access system 220 may include one or more device sensors configured to communicate with and detect the security device 218, a control element (e.g., a touch pad, a button, an infrared beam, etc.) configured to activate the electronic drive 200 without requiring physical keys, a notification system configured to display at least one status condition, and one or more printed circuit boards that mechanically support and electrically connect one or more electronic components or electrical components that enable operation of the access system 220 described herein. For example, electronic/electrical components may include memory, processors, light emitting diodes (LED), antennas, communication and control components, etc., coupled to a printed circuit board.

In the example, the access system 220 may be a separate unit from the electronic drive 200 so that it can be mounted away from the lock assembly 202 and enable the sensors and antennas to function without interference. Furthermore, this configuration enables the control element to be positioned on the door and at a location that facilitates ease of use for the user. In other examples, the access system 220 may be integrated with a handle assembly, for example, the handle assembly 116 described above in FIG. 1. For example, the handle assembly may include the device sensor on an interior escutcheon, the control element on an exterior escutcheon, and the notification system on one or both of the interior escutcheon and the exterior escutcheon. This configuration enables for various handle styles to be used with the electronic drive 200 as required or desired.

To remotely operate the lock assembly 202, the control element (e.g., mounted on the handle assembly) that is operatively coupled to the access system 220 and the electronic drive 200 may be used. When the control element is actuated, a signal is sent to the access system 220 to drive the electronic drive 200 and rotate the driven disk 216 to either lock or unlock the locking elements 206. For example, based on the position of the motor drive unit 212, the access system 220 can determine that the locking elements 206 are in a locked position, and thus, move the motor drive unit 212 so that the locking elements 206 are moved towards an unlocked position, or determine that the locking elements 206 are in an unlocked position, and thus, move the motor drive unit 212 so that the locking elements 206 are moved towards a locked position. The access system 220 may then also display one or more status conditions (e.g., "locked" or "unlocked") of the electronic drive 200 at the notification system. Because the control element can be a single button actuator (e.g., a touch pad) that is disposed on the exterior side of the handle assembly, the electronic drive 200 is easy to operate. In order to lock and unlock the lock assembly 202, a user need only to press the control element without having to enter an access code or have a physical key. In other examples, a button, a switch, a sensor, or other signal-sending device may be used in place of the touch pad as required or desired. However, for security and/or any other reasons, the access system 220 is configured to restrict control of the control element to only authorized users. This enables the access system 220 to prevent unauthorized access through the door, while still utilizing a single control element for ease of use.

To provide user authorization of the electronic drive 200 and the access system 220, the security device 218 can be used. The security device 218 may be a mobile device such as a phone or a key fob that can wirelessly communicate with the access system 220. Before using the electronic drive 200, one or more security devices 218 can be linked (e.g., authenticated) with the access system 220 so that access through the door is restricted and not available to everyone. For example, a small aperture (e.g., the size of a paper clip) may be located within the access system 220 that enables access to a small button, and when pressed, begins the authentication process for the security device 218. In one example, once the security device 218 is authenticated with the access system 220, an authentication code can be stored in the security device 218 so that the access system 220 can search and determine if the security device 218 matches an authorized device when the control element is actuated. In other examples, any other authorization protocols may be used to link the security device 218 and the access system 220 as required or desired.

When the security device 218 includes key fobs for use with the access system 220, the key fob may be pre-loaded with an authentication code that is uploaded to the access system 220 for subsequent authorization determinations. Authentication may also be provided by a dedicated computer application on the security device 218 (e.g., mobile phone) that can connect to the access system 220. Use of the application enables an intuitive user interface to manage authenticated devices with the access system 220 and facilitate ease of use of the electronic drive 200.

After the initial setup between the security device 218 and the access system 220, access through the door is easy to operate via the control element. Additionally, the communication transmitted between the security device 218 and the access system 220 can be encrypted with high-level encryption codes and provide resistance to malicious intrusion attempts. In comparison with other systems (e.g., an electronic lock keypad), the user interface is greatly simplified with a control element and use of an application to manage the authenticated device(s).

In other examples, the access system 220 can be configured (e.g., through the user interface application) to temporarily enable the control element without requiring the security device 218. This can enable third parties (e.g., repair people, dog walkers, movers, etc.) to have temporary access to the door as required or desired while still maintaining security of the electronic drive 200. For example, the control element may be enabled for a predetermined number of uses, a predetermined date/time range for use, or a one-time only use without the security device 218 being present. In still other examples, the access system 220 may generate temporary authorization codes (e.g., through the user interface application) that can be sent to third parties for temporary access to the door. These temporary authorization codes may be enabled for a predetermined number of uses or a predetermined date/time range for use.

The access system 220 (e.g., via one or more antennas (not shown)) can have a predetermined range area (e.g., approximately 10 feet, 15 feet, 20 feet, etc.) such that the security device 218 must be present within the range area in order for the access system 220 to authorize the security device 218 and to be enabled for the operation of the electronic drive 200. In some examples, the range area of the access system 220 may be user defined, for example, through the application user interface. By defining the range area of the access system 220, the operation of the electronic drive 200 can be limited to only when the security device 218 is located proximate the access system 220. This reduces the possibility of the control element being enabled after authorized users leave the door area or when authorized users are merely walking by the door.

In addition to the access system 220 detecting the presence of the security device 218, the access system 220 also can determine a position of the security device 218 relative to the door so that the access system 220 is not enabled when authorized users are located on the interior side of the door. As such, an unauthorized user cannot lock and/or unlock the lock assembly 202 when an authorized user is inside and proximate the access system 220. In the example, the access system 220 can determine whether the security device 218 is disposed on an exterior side of the door or disposed on an interior side of the door.

In operation, upon actuation of the control element, the access system 220 is configured to detect a presence of the security device 218 to verify that the security device 218 is within range; determine a position of the security device 218 relative to the access system 220 (e.g., on the interior or exterior side of the sliding door); and determine whether the security device 218 is authorized for use with the access system 220. When there is an authorized device within range and adjacent to the exterior of the door, the access system 220 will engage the lock assembly 202 and lock or unlock the door. It should be appreciated that the access system 220 may perform any of the above operation steps in any sequence as required or desired. For example, the access system 220 may automatically search for the security devices 218 at predetermined time periods (e.g., every 10 seconds). Thus, the access system 220 can pre-determine whether an authorized device is present and outside of the door before the control element is actuated. In other examples, the access system 220 may first determine authorization of the security device 218 and then determine its relative position before enabling operation of the electronic drive 200.

In some examples, the notification system of the access system 220 may provide an audible and/or visual indicator during the operation of the electronic drive 200. This enables audible and/or visual feedback for users during control of the lock assembly 202 by the access system 220. Additionally, although the door is described as having an interior and exterior side, these orientations are merely for reference only. Generally, the access system 220 and electronic drive 200 may be used for any door, gate, or panel that separates a controlled access area from an uncontrolled access area, whether it is inside a structure, outside of a structure, or between the inside and outside of a structure. Examples of systems that have similar operation with the access system 220 described herein (e.g., using the security device 218 to determine access and the locking/unlocking of the lock assembly 202) are U.S. patent application Ser. No. 16/045,161, filed Jul. 25, 2018, entitled "ACCESS HANDLE FOR SLIDING DOORS" and U.S. patent application Ser. No. 16/014,963, filed Jun. 21, 2018, entitled "GARAGE DOOR ACCESS REMOTE," both disclosures of which is hereby incorporated by reference herein in there entireties.

Figure 3A:
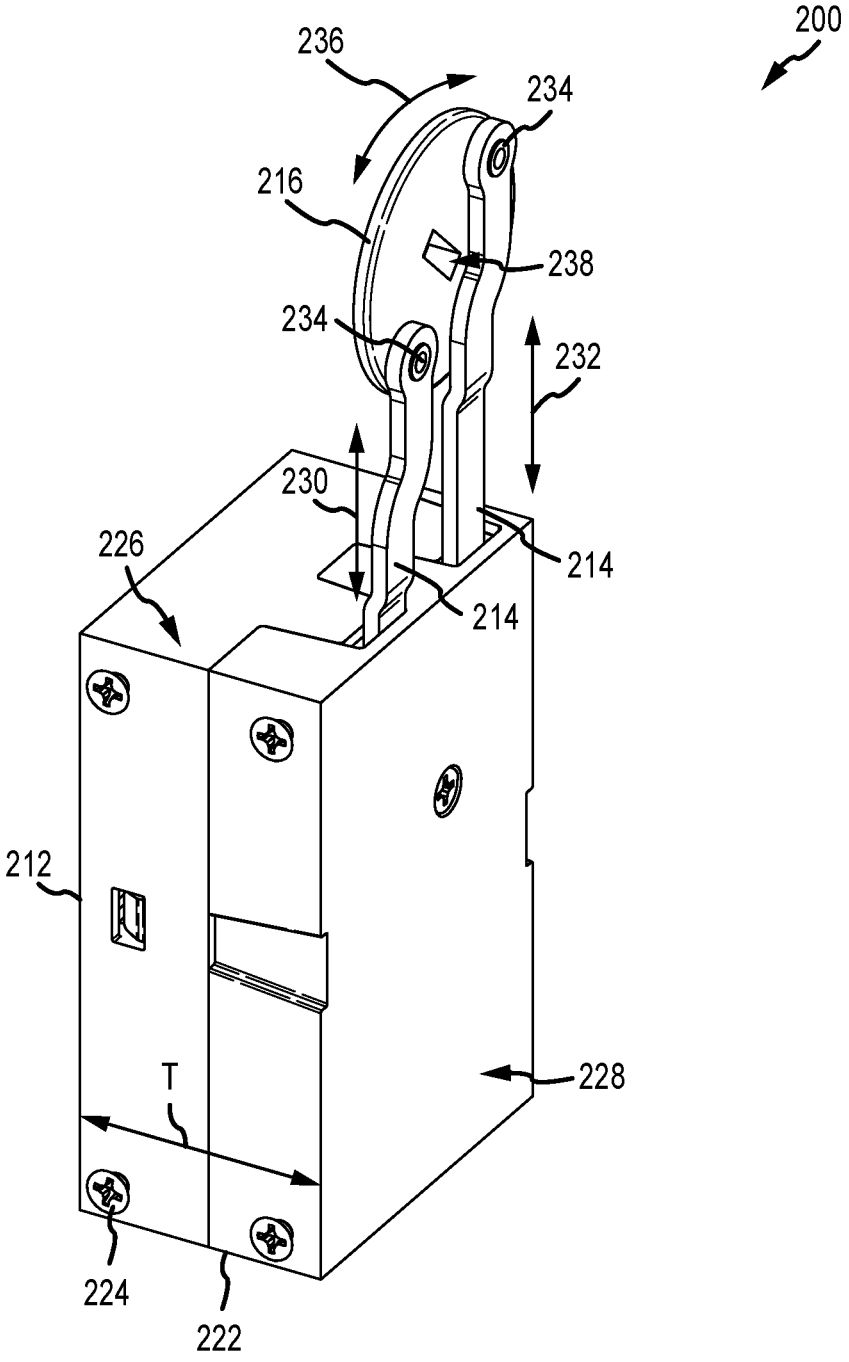
FIG. 3A is a perspective view of the electronic drive shown in FIG. 2A.

FIG. 3A is a perspective view of the electronic drive 200. As described above, the electronic drive 200 includes the motor drive unit 212, the pair of link bars 214 extending therefrom, and the driven disk 216. The motor drive unit 212 includes a housing 222 that may be coupled to the faceplate 208 (shown in FIGS. 2A and 2B) by one or more fasteners 224. The housing 222 may be a two-piece housing that can snap-fit together and enable access to the components contained therein. Extending from an end portion 226 of the housing 222 are the pair of link bars 214. The link bars 214 are disposed proximate a first side 228 of the housing 222 and offset from a centerline thereof. This position of the link bars 214 enables the driven disk 216 to be coupled to the lock assembly 202 (shown in FIGS. 2A and 2B) along its side and reduce the thickness T of the electronic drive 200. Furthermore, the link bars 214 may include one or more dog-leg sections that enable the driven disk 216 to be positioned over the end portion 226 of the housing 222 and maintain the reduced thickness T of the electronic drive 200.

The link bars 214 are configured to extend from and retract into (e.g., arrows 230, 232) the housing 222. In the example, the link bars 214 are configured to move in opposite directions, and when one link bar retracts the other link bar is extending. The free end of each link bar 214 is coupled to the driven disk 216 at a pivot point 234. The substantially linear movement 230, 232 of the link bars 214 induce a corresponding rotational movement 236 into the driven disk 216 so as to operate the lock assembly 202 (shown in FIGS. 2A and 2B) as required or desired. The driven disk 216 is configured to couple to the exterior of the lock assembly 202 (e.g., directly or via a drive tail) and also has an opening 238 so that a drive tail from a thumbturn or a key cylinder (both not shown) can still be used for manual lock assembly operation.

Figure 3B:
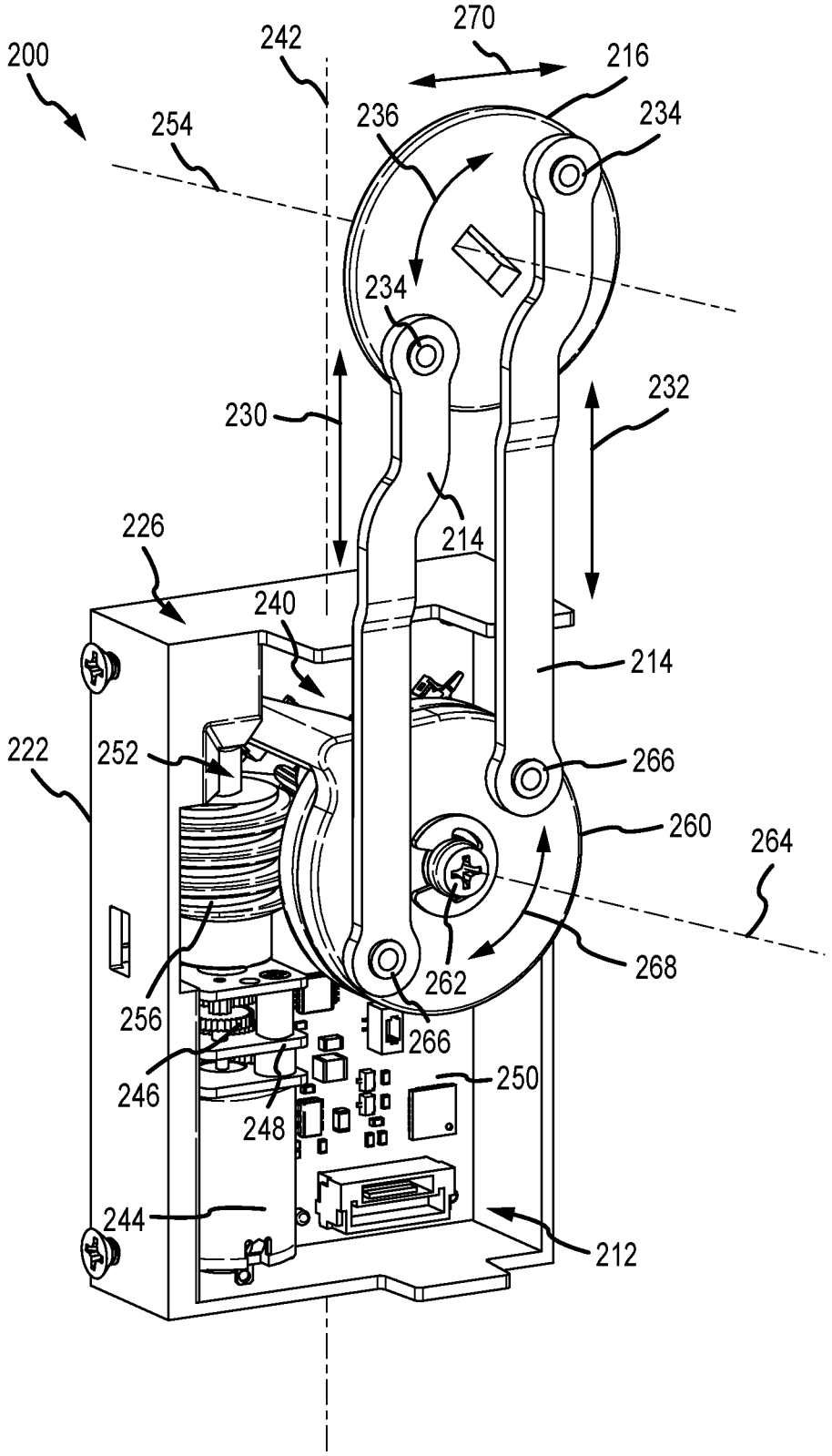
FIGS. 3B and 3C are perspective views the electronic drive with a portion of a housing removed.
Figure 3C:
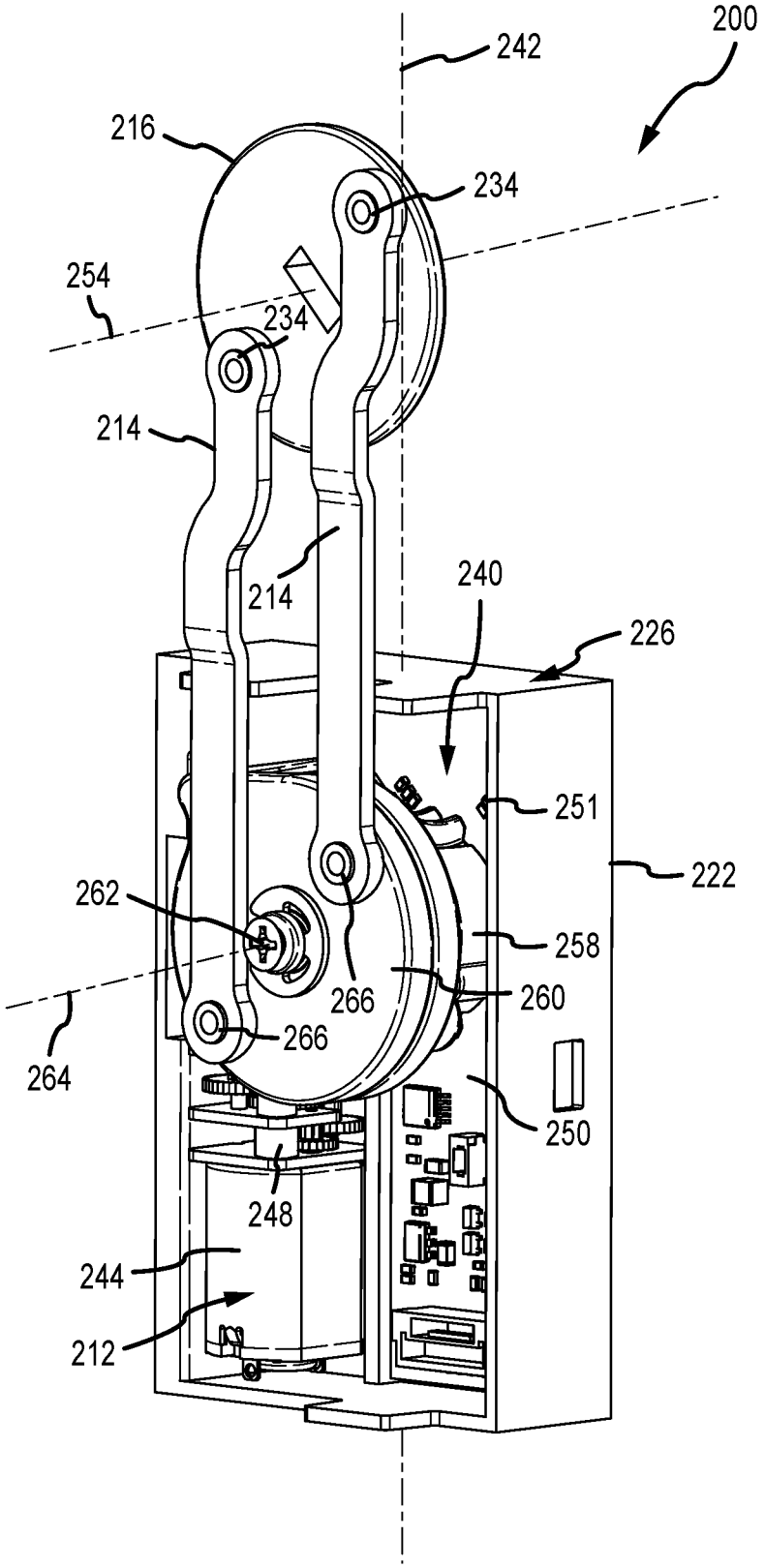

FIGS. 3B and 3C are perspective views the electronic drive 200 with a portion of the housing 222 removed. Referring concurrently to FIGS. 3B and 3C, the housing 222 defines an interior cavity 240 in which the motor drive unit 212 is disposed. Additionally, the housing 222 defines a longitudinal axis 242 that is substantially orthogonal to the end portion 226 of the housing 222. The motor drive unit 212 includes a motor 244 that is configured to rotatably drive a motor shaft (not shown) extending substantially parallel to the longitudinal axis 242. The motor 244 may be an off-the-shelf DC unit that includes an integral gear set 246 surrounded by a chassis 248 and is communicatively and/or electrically coupled to a printed circuit board (PCB) 250 supported within the housing 222. The PCB 250 is configured to control operation of the motor 244 and/or provide feedback to other controller components (e.g., the access system 220 (shown in FIGS. 2A and 2B)), and includes any number of components that enable this function and operation. For example, the PCB 250 may include one or more resistors, light emitting diodes, transistors, capacitators, inductors, diodes, switches, power supply, connectors, speakers, antennas, sensors, memory, processors, etc. In one example, a position sensor 251 may be included so as to determine a position of one or more components of the motor drive unit 212.

In the example, the motor 244 is coupled to the driven disk 216 via a worm drive 252 and the pair of link bars 214 so that the motor 244 can drive rotation of the driven disk 216 about a first rotational axis 254. The first rotational axis 254 is substantially orthogonal to the longitudinal axis 242. The worm drive 252 includes a worm 256 coupled to the motor shaft and is rotatably driven by the motor 244. The motor 244 can rotate the worm 256 in either direction (e.g., clockwise or counter-clockwise) so that the electronic drive 200 can both lock and unlock the lock assembly 202 (shown in FIGS. 2A and 2B). The worm 256 meshes with a worm gear 258 that is coupled to a clutch assembly 260. The worm gear 258 and the clutch assembly 260 are supported on a spindle 262 that defines a second rotational axis 264. The second rotational axis 264 is substantially parallel to and offset from the first rotational axis 254 and both are substantially orthogonal to the longitudinal axis 242. Each link bar 214 is coupled to the clutch assembly 260 at pivot points 266 and the link bars 214 extend substantially parallel to the longitudinal axis 242. As illustrated in FIGS. 3B and 3C, the worm drive 252 is the gear arrangement that translates movement generated by the motor 244 to the driven disk 216. Additionally or alternatively, any other gear arrangement that enables operation of the electronic drive 200 as described herein may be used as required or desired.

In operation, the electronic drive 200 couples to the lock assembly 202 and is configured to automatically extend and/or retract the locking elements therefrom. More specifically, upon the motor 244 driving rotation of the worm 256, the worm gear 258 and the clutch assembly 260 rotate 268 about the second rotational axis 264 and the spindle 262. The rotational movement 268 of the clutch assembly 260 drives opposing linear movement 230, 232 of the pair of link bars 214 along the longitudinal axis 242. That is one link bar 214 moves in a first direction along the longitudinal axis 242 and the other link bar 214 moves in an opposite second direction along the longitudinal axis 242. This linear movement of the link bars 214 translates the rotational movement 268 of the clutch assembly 260 into a corresponding rotation 236 of the driven disk 216 around the first rotational axis 254 for actuation of the lock assembly 202. In the example, both the clutch assembly 260 and the driven disk 216 rotate in the same direction during operation. Furthermore, it is appreciated that since the pivot points 234, 266 rotate with the clutch assembly 260 and the driven disk 216, respectively, this rotational movement not only linearly moves 230, 332 the link bars 214, but also slightly translates 270 the link bars 214 away or towards each other as well. However, the linear movement 230, 232 distance is much greater than the translational movement 270 distance.

Additionally, the electronic drive 200 enables for the lock assembly 202 to be manually extended and/or retracted as required or desired. Accordingly, the electronic drive 200 is configured to enable manual rotation of a portion of the motor drive unit 212 without affecting operation of the automatic portion of the motor drive unit 212 as described above. In the example, the driven disk 216 may be coupled to a thumbturn and/or a key cylinder (both not shown) that are used to manually rotate 236 the driven disk 216 about the first rotational axis 254. The rotational movement 236 of the driven disk 216 drives opposing linear movement 230, 232 of the pair of link bars 214 along the longitudinal axis 242 and this linear movement induces rotational movement 268 of the clutch assembly 260 about the second rotational axis 264 and the spindle 262. However, the clutch assembly 260 is configured to prevent the rotational movement 268 to be transferred to the worm gear 258 so that the worm 256 is not manually rotated and undesirable wear is not induced into the motor 244 and the gear set 246. The worm gear 258 and the clutch assembly 260 are described further below.

Figure 4:
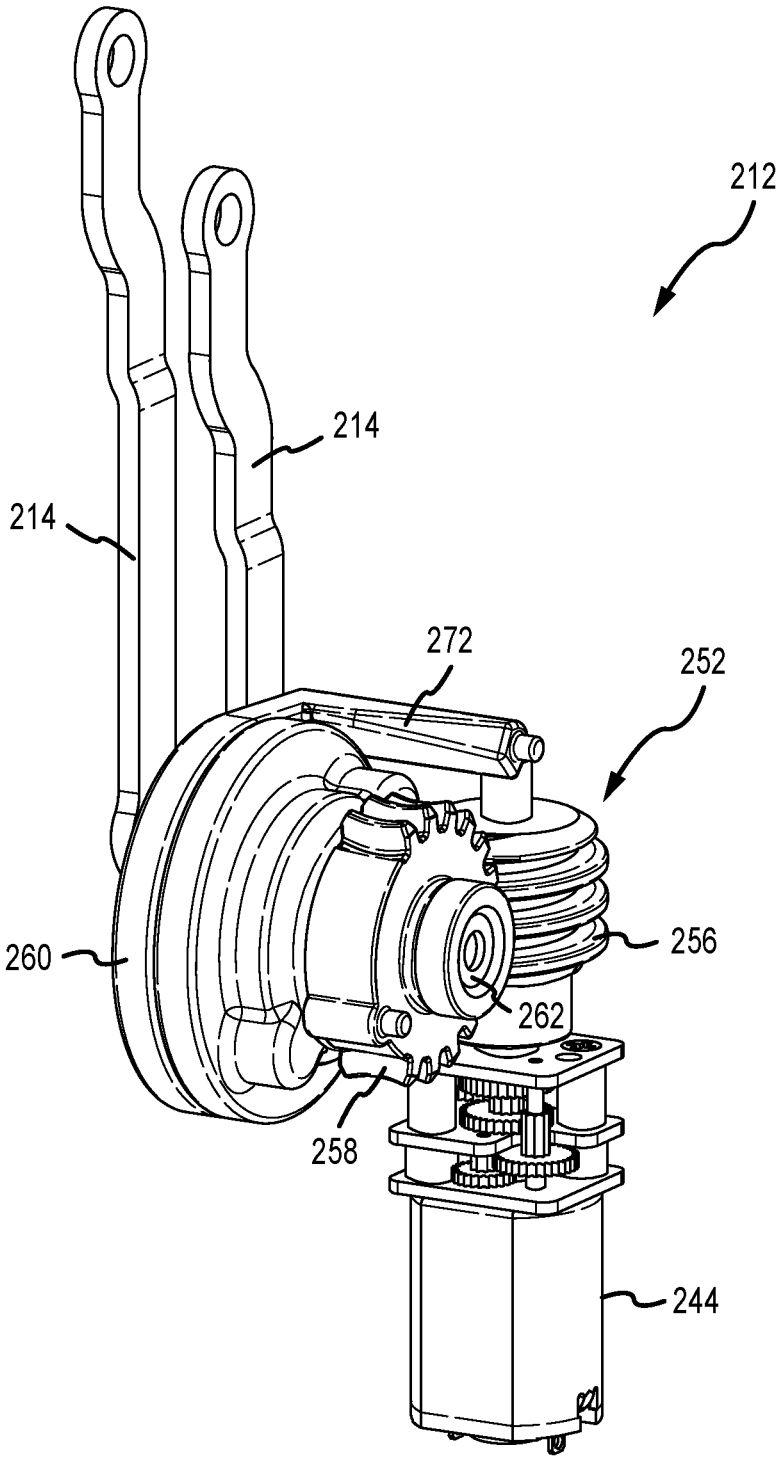
FIG. 4 is a perspective view of a motor drive unit of the electronic drive shown in FIG. 2A.

FIG. 4 is a perspective view of the motor drive unit 212 of the electronic drive 200 (shown in FIGS. 3A-3C) with the driven disk 216 and housing 222 not shown for clarity. As described above, the motor drive unit 212 includes the motor 244 coupled to the worm 256 with both extending substantially orthogonal to the spindle 262. Attached to the spindle 262 is the worm gear 258 and the clutch assembly 260 that has the link bars 214 extending therefrom. The worm 256 and the worm gear 258 from the worm drive 252. The clutch assembly 260 includes an arm 272 that extends towards the PCB 250 (shown in FIGS. 3B and 3C) and engages with the position sensor 251 (shown in FIG. 3C) so that the position of the clutch assembly 260, and thereby, the lock assembly 202 (shown in FIGS. 3B and 3C), can be determined. The position sensor may be a mechanical switch, a magnetic sensor, or any other sensor that enables the position of the clutch assembly 260 to be determined. In the example, the arm 272 engages with a mechanical switch in order to provide feedback as to the position of the clutch assembly 260. By using a mechanical switch, interference in the PCB 250 by magnetic fields (e.g., by a magnetic sensor) is reduced, and thereby, increases the performance of the electronic drive 200.

In operation, after the clutch assembly 260 is rotated by the motor 244 to actuate the lock assembly 202 and extend or retract the locking elements, the motor drive unit 212 automatically returns to a centered neutral position. By returning to this position, the clutch assembly 260 is configured to rotate due to manual rotation (e.g., by the thumbturn or key cylinder) without rotating the worm gear 258 and inducing undesirable wear into the motor 244. Additionally or alternatively, the worm drive 252 may be replaced by, or augmented by, any other mechanical linkage (e.g., drive bar, helical gears, spur gears, etc.) that enable the motor drive unit 212 to function as described herein.

Figure 5:
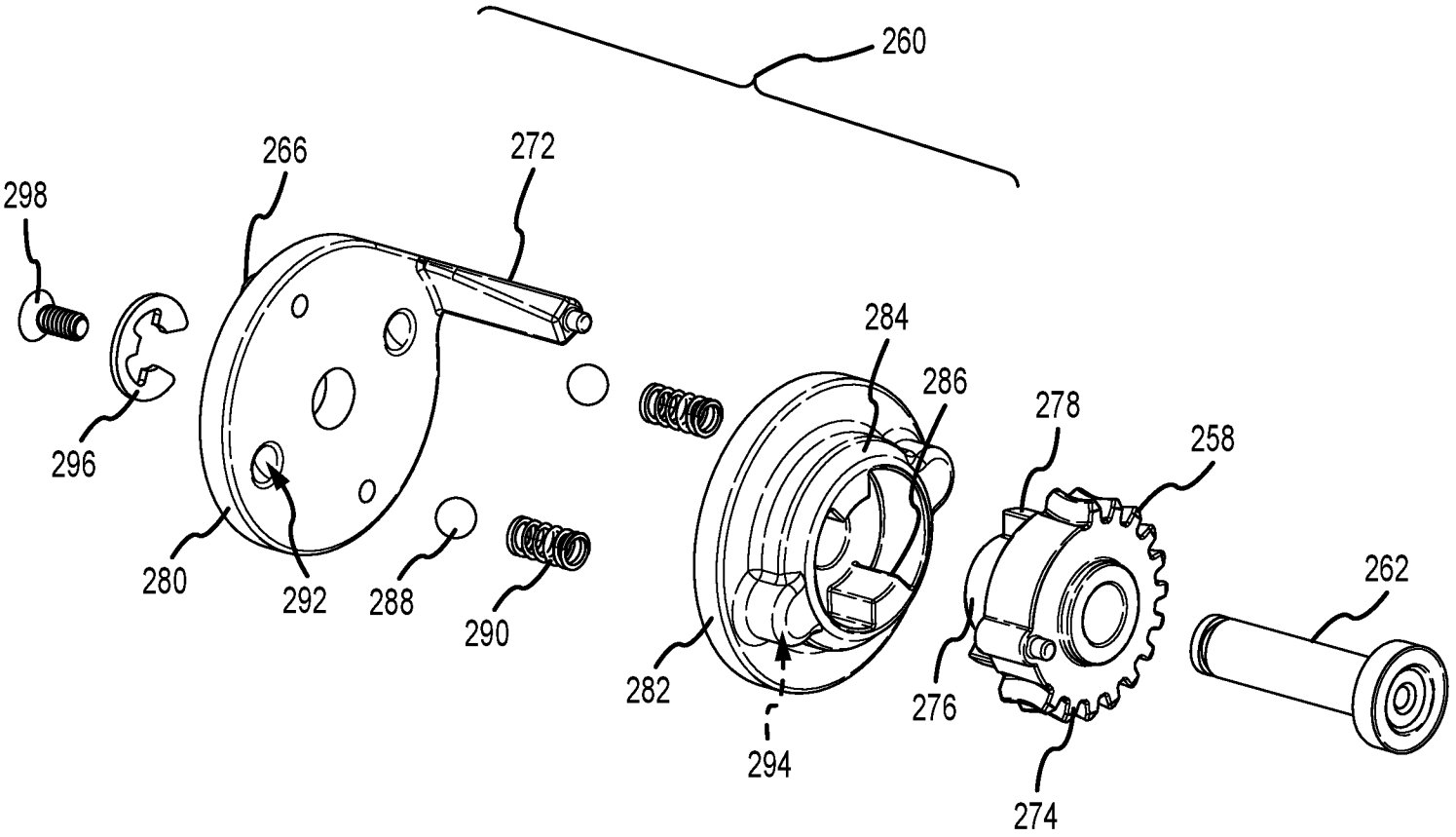
FIG. 5 is an exploded perspective view of a clutch assembly and a worm gear of the motor drive unit shown in FIG. 4.

FIG. 5 is an exploded perspective view of the clutch assembly 260 and the worm gear 258. The worm gear 258 includes a first end defining a circumferential rack 274 that engages with the worm 256 and forms the worm drive 252 (both shown in FIG. 4). An opposite second end of the worm gear 258 includes a drive hub 276 with at least one drive lug 278 extending therefrom. In the example, the drive hub 276 has two drive lugs 278 that are spaced approximately 180° from one another. The drive hub 276 and the drive lugs 278 are sized and shaped to be received in a first end of the clutch assembly 260 so as to drive rotation of the clutch assembly via the motor 244 (shown in FIG. 4).

The clutch assembly 260 includes a clutch disk 280 that is coupled to a lost motion disk 282. A first end of the lost motion disk 282 includes a driven hub 284 with at least one driven lug 286 extending therefrom. In the example, the driven hub 284 has two driven lugs 286 that are spaced approximately 180° from one another. The driven hub 284 is configured to receive at least a portion of the drive hub 276 of the worm gear 258. However, when the drive hub 276 is engaged with the driven hub 284, the lugs 278, 286 are not necessary engaged. The circumferential spacing of the lugs 278, 286 (e.g., each set being positioned at 180° from each other) enables the clutch assembly 260 to at least partially freely rotate relative to the worm gear 258 before the lugs 278, 286 engage. For example, the drive hub 276 or the driven hub 284 may freely rotate approximately 90° before the lugs 278, 286 engage with each other and rotational movement is transferred between the clutch assembly 260 and the worm gear 258.

In the example, this free rotation between the hubs 276, 284 is enabled because in a centered neutral position, the drive lugs 278 are spaced approximately 90° from the driven lugs 286. The free rotation enables for the worm gear 258 to return to the centered neutral position after extending or retracting (e.g., both rotation directions) the lock assembly 202 (shown in FIGS. 2A and 2B) without further rotating the clutch assembly 260, and thereby, the lock assembly. Additionally, once the worm gear 258 is in the centered neutral position, manual rotation of the clutch assembly 260 (e.g., by the thumbturn or the key cylinder) in either rotation direction does not cause corresponding rotation of the worm gear 258, and thereby, undesirable wear to the motor 244.

The clutch disk 280 is coupled to the lost motion disk 282 by a tension system having a ball 288 and a spring 290. This tension system enables the clutch assembly 260 to rotate as a single unit under typical operating conditions. However, if the motor 244 and/or the worm drive 252 binds up in a position other than the centered neutral position (e.g., in a position where the lugs 278, 286 are engaged or partially engaged), then the tension system releases the coupling between the clutch disk 280 and the lost motion disk 282 upon reaching a predetermined load value to reduce or prevent undesirable wear to the motor 244. For example, if the worm gear 258 is in a position other than the center neutral position when the clutch assembly 260 is manually rotated (e.g., via use of the thumbturn or key-cylinder), once the manual rotation induces a predetermined load (e.g., greater than the pre-tensioning of the tension system) to the clutch disk 280, then the tension system releases the coupling between the clutch disk 280 and the lost motion disk 282. Once the clutch disk 280 is rotationally decoupled from the lost motion disk 282, the lock assembly 202 can continue to be manually operable without inducing undesirable wear on the drive system components. After the manually induced load on the clutch disk 280 is released, then the tension system can return to rotationally coupling the clutch disk 280 together with the lost motion disk 282 as a single unit.

In the example, a first end of the clutch disk 280 includes one or more pockets 292 defined therein. The pockets 292 are sized and shaped to receive and engage the balls 288 that are engaged with the spring 290. The spring 290 is received and engage within a corresponding recess 294 defined in a second end of the lost motion disk 282. The spring 290 provides a tension force that secures the clutch disk 280 and the lost motion disk 282 together so they rotate as a single unit (e.g., the clutch assembly 260) and enable operation of the drive as described herein. However, once the tension force is overcome, the clutch disk 280 may at least partially rotate separately from the lost motion disk 282. The second end of the clutch disk 280 couples to the link bars 214 (shown in FIGS. 3A-3C) with the pivot points 266 and includes the arm 272 that facilitates determining the position of the clutch assembly 260 as described herein.

The clutch assembly 260 and the worm gear 258 are rotationally supported on the spindle 262 and secured in place by an E-clip 296. A fastener 298 may be used to couple the clutch assembly 260, worm gear 258, and spindle 262 to the housing 222 (shown in FIGS. 2A and 2B). In an example, this spindle component assembly may be assembled separately from the rest of the components of the electronic drive 200 (shown in FIGS. 3A-3C) so that the tension system can be more easily installed and compressed to pre-load the clutch assembly 260. This can facilitate more efficiencies in the manufacturing process.

Figure 6:
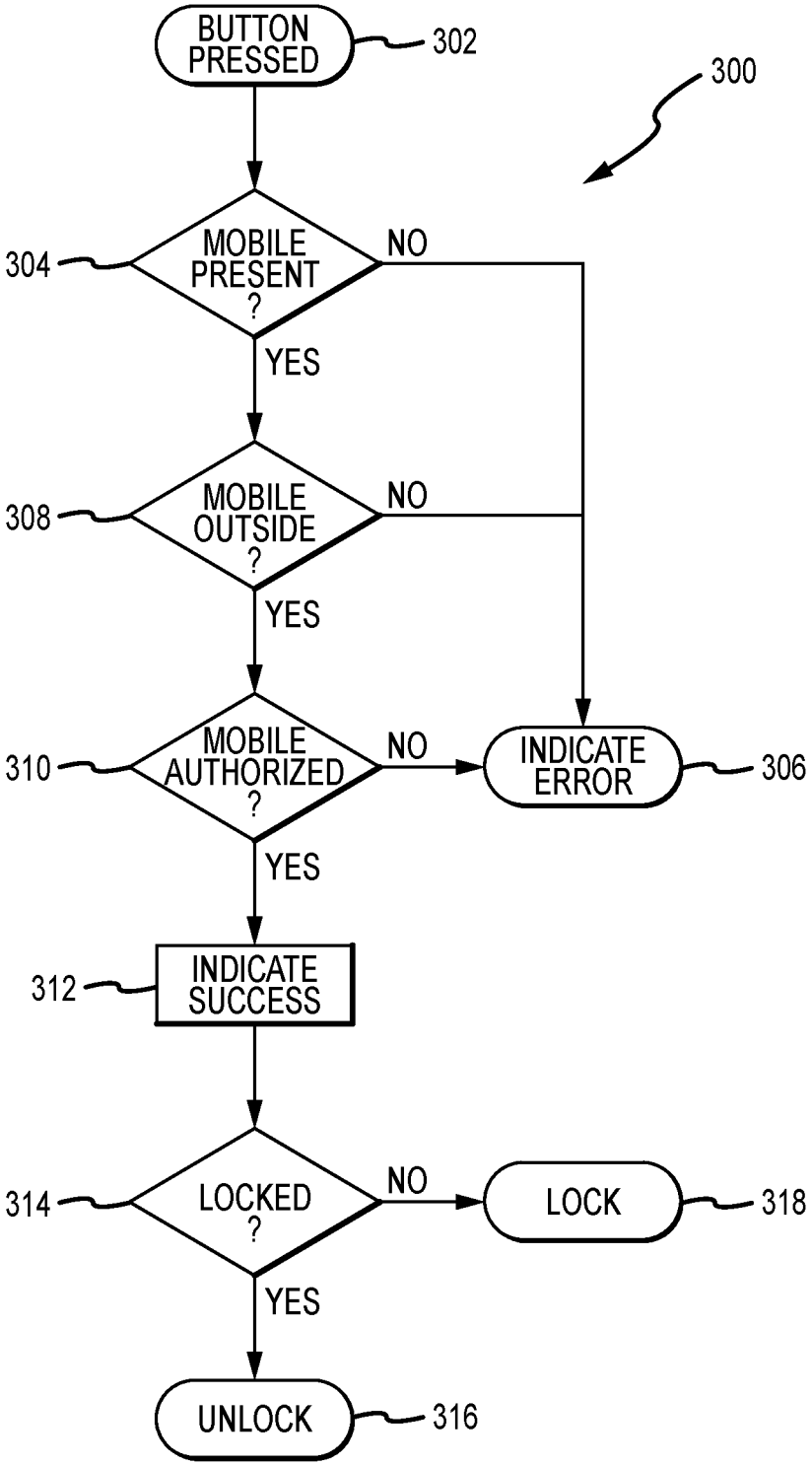
FIG. 6 is flowchart illustrating a method of operating a lock assembly.

FIG. 6 is flowchart illustrating a method 300 of operating a lock assembly. The method 300 begins with actuating a control element of an access system (operation 302). Once the control element is pressed a signal is sent and received at the access system that controls operation of an electronic drive. Upon receipt of a signal, the access system detects a presence of a security device relative to the door (operation 304). If the access system detects that no security device is present within its range, then a status condition (e.g., an error indication) of the electronic drive may be indicated on the notification system (operation 306).

However, when the access system detects that there is a security device present, then the access system determines a position of the security device relative to the door (operation 308). If the access system determines that the security device is inside of the door, then a status condition of the electronic drive assembly may be indicated on the notification system (operation 306). However, when the security device is present and outside of the door, then the access system determines an authorization of the security device (operation 310). If the access system determines that the security device is unauthorized, then a status condition of the electronic drive may be indicated on the notification system (operation 306).

When the security device is positioned proximate the access system, located on the exterior of the door, and authorized to operate the electronic drive, the electronic drive can be operated and a status condition (e.g., a success indication) indicated on the notification system (operation 312). For example, the success indication can be a notification that the lock assembly is locking if originally unlocked or unlocking if originally locked. In some examples, operating the electronic drive can further include rotating a clutch assembly coupled to a pair of link bars, and after moving the lock assembly to one of a locked position and an unlocked position, returning the clutch assembly to a center neutral position. While operations 304, 308, 310 are illustrated as being in order in FIG. 6, it is appreciated that these operations may be performed at any time and in any order as required or desired. Once the lock assembly is to be locked or unlocked, the method 300 further includes sensing a position of the electronic drive by a sensor (operation 314). As such, when the lock assembly is locked, the access system operates the lock assembly to unlock (operation 316), and when the lock assembly is unlocked, the access system operates the lock assembly to lock (operation 318).

Figure 7:
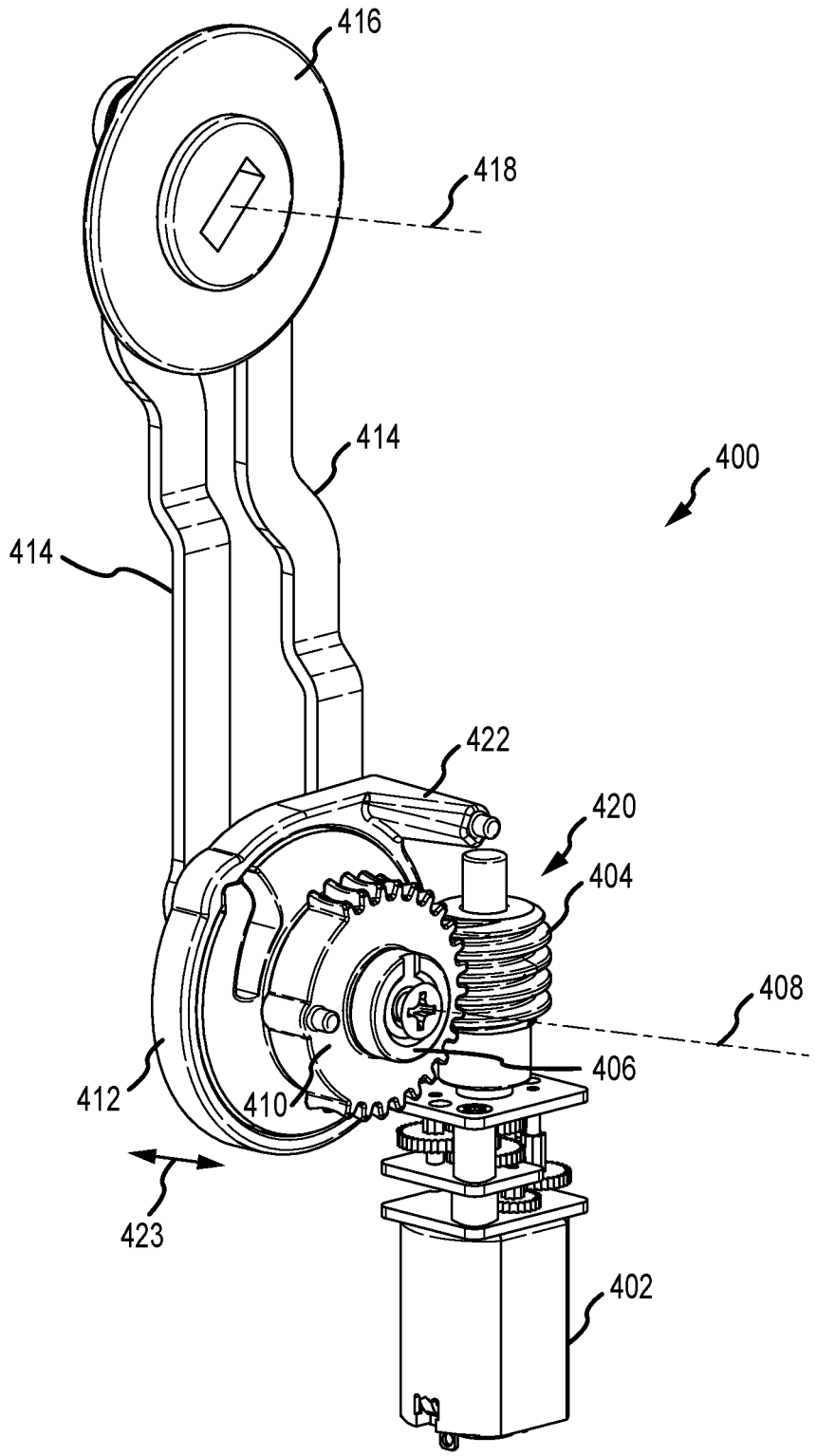
FIG. 7 is a perspective view of another motor drive unit that can be used with the electronic drive shown in FIG. 2A.

FIG. 7 is a perspective view of another motor drive unit 400 that can be used with the electronic drive 200 (shown in FIGS. 3A-3C). Similar to the example described above in reference to FIGS. 4 and 5, the motor drive unit 400 includes a motor 402 coupled to a worm 404 with both components extending substantially parallel to the longitudinal axis of the drive housing (not shown) and extending substantially orthogonal to a spindle 406 that defines a rotational axis 408. Attached to the spindle 406 is a worm gear 410 and a clutch assembly 412 that has two link bars 414 extending therefrom. The link bars 414 are coupled to a driven disk 416 that is rotatable about a rotational axis 418. The worm 404 and the worm gear 410 form a worm drive 420. The clutch assembly 412 includes an arm 422 oriented to engage with a position sensor (e.g., the sensors 251 shown in FIG. 3C) so that the position of the clutch assembly 412 can be determined. For example, a rotational position of the clutch assembly 412 can be determined so that locking/unlocking operations can be performed by the electronic drive as described herein.

In operation, after the clutch assembly 412 is rotated by the motor 402 to actuate the lock assembly 202 (shown in FIG. 2A) and extend or retract the locking elements, the motor drive unit 400 automatically returns to a centered neutral position. By returning to this position, the clutch assembly 412 is configured to rotate due to manual rotation (e.g., by the thumbturn or key cylinder) without rotating the worm gear 410 and inducing undesirable wear into the motor 402. Additionally or alternatively, the worm drive 420 may be replaced by, or augmented by, any other mechanical linkage (e.g., drive bar, helical gears, spur gears, etc.) that enable the motor drive unit 400 to function as described herein.

Additionally, in this example, the configuration of the clutch assembly 412 is thinner along a direction 423 extending substantially parallel to and along the rotational axis 408, when compared to the clutch assembly 260 described in FIGS. 4 and 5 above. By reducing the thickness of the clutch assembly 412, the thickness T of the housing of the electronic drive 200 (shown in FIG. 2B) is further reduced. This increases the performance and efficiency of the electronic motor drive (e.g., manufacturing, installation, operation, etc.).

Figure 8:
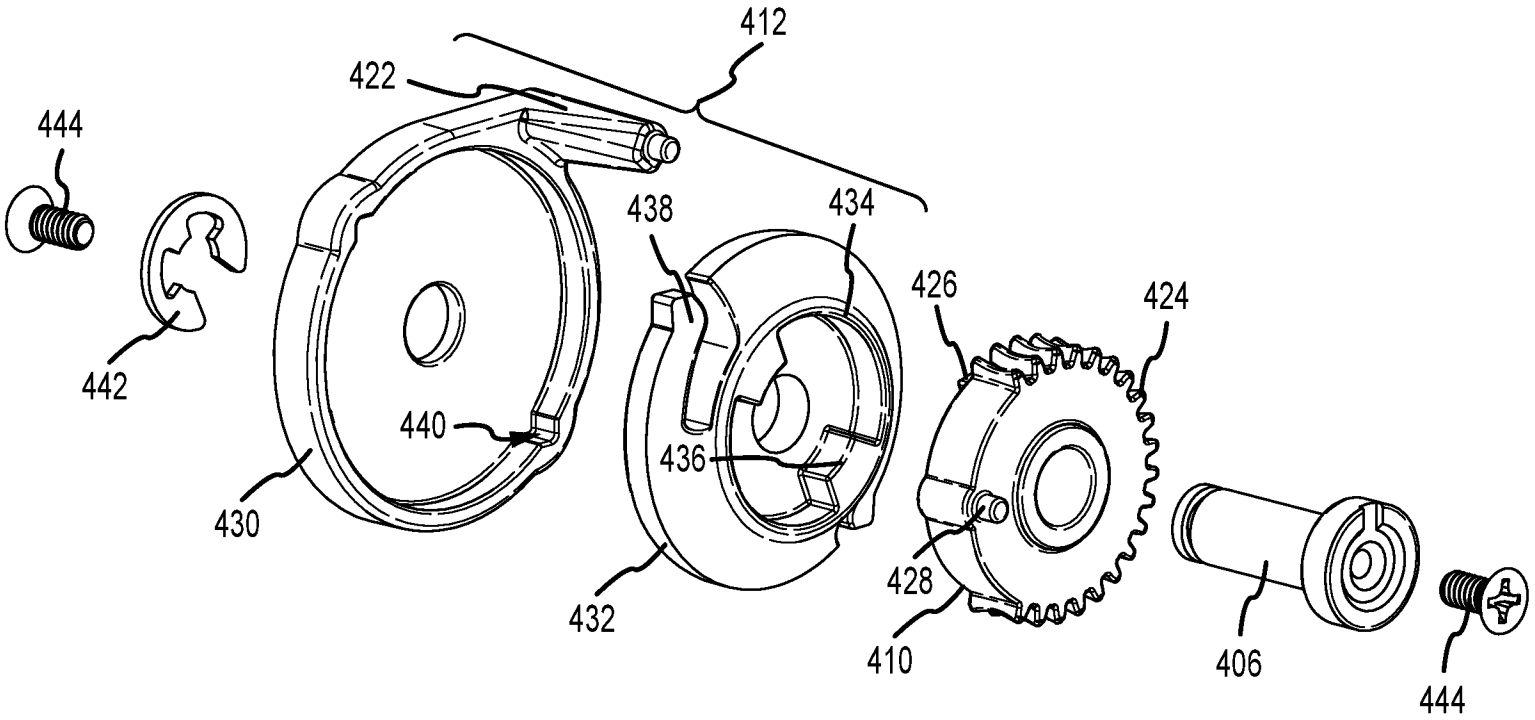
FIG. 8 is an exploded perspective view of a clutch assembly and a worm gear of the motor drive unit shown in FIG. 7.

FIG. 8 is an exploded perspective view of the clutch assembly 412 and the worm gear 410 of the motor drive unit 400 (shown in FIG. 7). The worm gear 410 includes a first end defining a circumferential rack 424 that extends at least partially around a perimeter of the gear 410 and engages with the worm 404 and forms the worm drive 420 (both shown in FIG. 7). An opposite second end of the worm gear 410 includes a drive hub 426 with at least one drive lug extending therefrom. In the example, the drive hub 426 has two drive lugs that are spaced approximately 180° from one another and similar to the example described above in FIG. 5. The drive hub 426 and the drive lugs are sized and shaped to be received in a first end of the clutch assembly 412 so as to drive rotation of the clutch assembly via the motor 402 (shown in FIG. 7). Additionally, an arm 428 may extend from the first end of the worm gear 410 and is oriented to engage with a position sensor (e.g., the sensors 251 shown in FIG. 3C) so that a position of the worm gear 410 can be determined. For example, a rotational position of the worm gear 410 can be determined so that locking/unlocking operations can be performed by the electronic drive as described herein.

The clutch assembly 412 includes a clutch disk 430 that is coupled to a lost motion disk 432. A first end of the lost motion disk 432 includes a driven hub 434 with at least one driven lug 436 extending therefrom. In the example, the driven hub 434 has two driven lugs 436 that are spaced approximately 180° from one another and similar to the example described above in FIG. 5. The driven hub 434 is configured to receive at least a portion of the drive hub 426 of the worm gear 410. However, when the drive hub 426 is engaged with the driven hub 434, the lugs are not necessary engaged. The circumferential spacing of the lugs (e.g., each set being positioned at 180° from each other) enables the clutch assembly 412 to at least partially freely rotate relative to the worm gear 410 before the lugs engage. For example, the drive hub 426 or the driven hub 434 may freely rotate approximately 90° before the lugs engage with each other and rotational movement is transferred between the clutch assembly 412 and the worm gear 410.

The free rotation between the hubs 426, 434 is enabled because in the centered neutral position, the drive lugs are spaced approximately 90° from the driven lugs. The free rotation enables for the worm gear 410 to return to the centered neutral position after extending or retracting (e.g., both rotation directions) the lock assembly 202 (shown in FIGS. 2A and 2B) without further rotating the clutch assembly 412, and thereby, the lock assembly. Additionally, once the worm gear 410 is in the centered neutral position, manual rotation of the clutch assembly 412 (e.g., by the thumbturn or the key cylinder) in either rotation direction does not cause corresponding rotation of the worm gear 410, and thereby, undesirable wear to the motor 402. Additionally, the rotational position of the clutch assembly 412 and the worm gear 410 can be determined by position sensors and the arms 422, 428 and enable operation of the system.

In this example, the clutch disk 430 is coupled to the lost motion disk 432 by a tension system having resilient spring fingers 438 of the lost motion disk 432 configured to engage with corresponding notches 440 within the clutch disk 430. This tension system enables the clutch assembly 412 to rotate as a single unit under typical operating conditions. However, if the motor 402 and/or the worm drive 420 binds up in a position other than the centered neutral position (e.g., in a position where the lugs are engaged or partially engaged), then the tension system releases the coupling between the clutch disk 430 and the lost motion disk 432 upon reaching a predetermined load value to reduce or prevent undesirable wear to the motor 402. For example, if the worm gear 410 is in a position other than the center neutral position when the clutch assembly 412 is manually rotated (e.g., via use of the thumbturn or key-cylinder), once the manual rotation induces a predetermined load (e.g., greater than the pre-tensioning of the tension system) to the clutch disk 430, then the tension system releases the coupling between the clutch disk 430 and the lost motion disk 432. Once the clutch disk 430 is rotationally decoupled from the lost motion disk 432, the lock assembly 202 can continue to be manually operable without inducing undesirable wear on the drive system components. After the manually induced load on the clutch disk 430 is released, then the tension system can return to rotationally coupling the clutch disk 430 together with the lost motion disk 432 as a single unit.

In the example, a first end of the clutch disk 430 is recessed so that at least a portion of the lost motion disk 432 is disposed within. One or more notches 440 radially extend from the recess and are circumferentially spaced around the perimeter of the clutch disk 430. The notches 440 are sized and shaped to receive and engage the spring fingers 438. When the spring fingers 438 are engaged with the notches 440, the spring fingers 438 provide a tension force that secures the clutch disk 430 and the lost motion disk 432 together so they rotate as a single unit (e.g., the clutch assembly 412) and enable operation of the drive as described herein. However, once the tension force is overcome (e.g., overcoming the biasing force of the fingers 438), the clutch disk 430 may at least partially rotate separately from the lost motion disk 432. The second end of the clutch disk 430 couples to the link bars 414 (shown in FIG. 7) and includes the arm 422 that facilitates determining the position of the clutch assembly 412 as described herein. Additionally, in this example, the thickness of the clutch assembly 412 along the rotation axis (e.g., the lost motion disk 432 received at least partially within the clutch disk 430 and the tension system being located towards the outer perimeter of the lost motion disk) enables the size of the electronic drive to be reduced.

The clutch assembly 412 and the worm gear 410 are rotationally supported on the spindle 406 and secured in place by an E-clip 442. One or more fasteners 444 may be used to couple the clutch assembly 412, worm gear 410, and spindle 406 to the housing 222 (shown in FIGS. 2A and 2B). In an example, this spindle component assembly may be assembled separately from the rest of the components of the electronic drive 200 (shown in FIGS. 3A-3C) so that the tension system can be more easily installed and compressed to pre-load the clutch assembly 412. This can facilitate more efficiencies in the manufacturing process.

Figure 9:
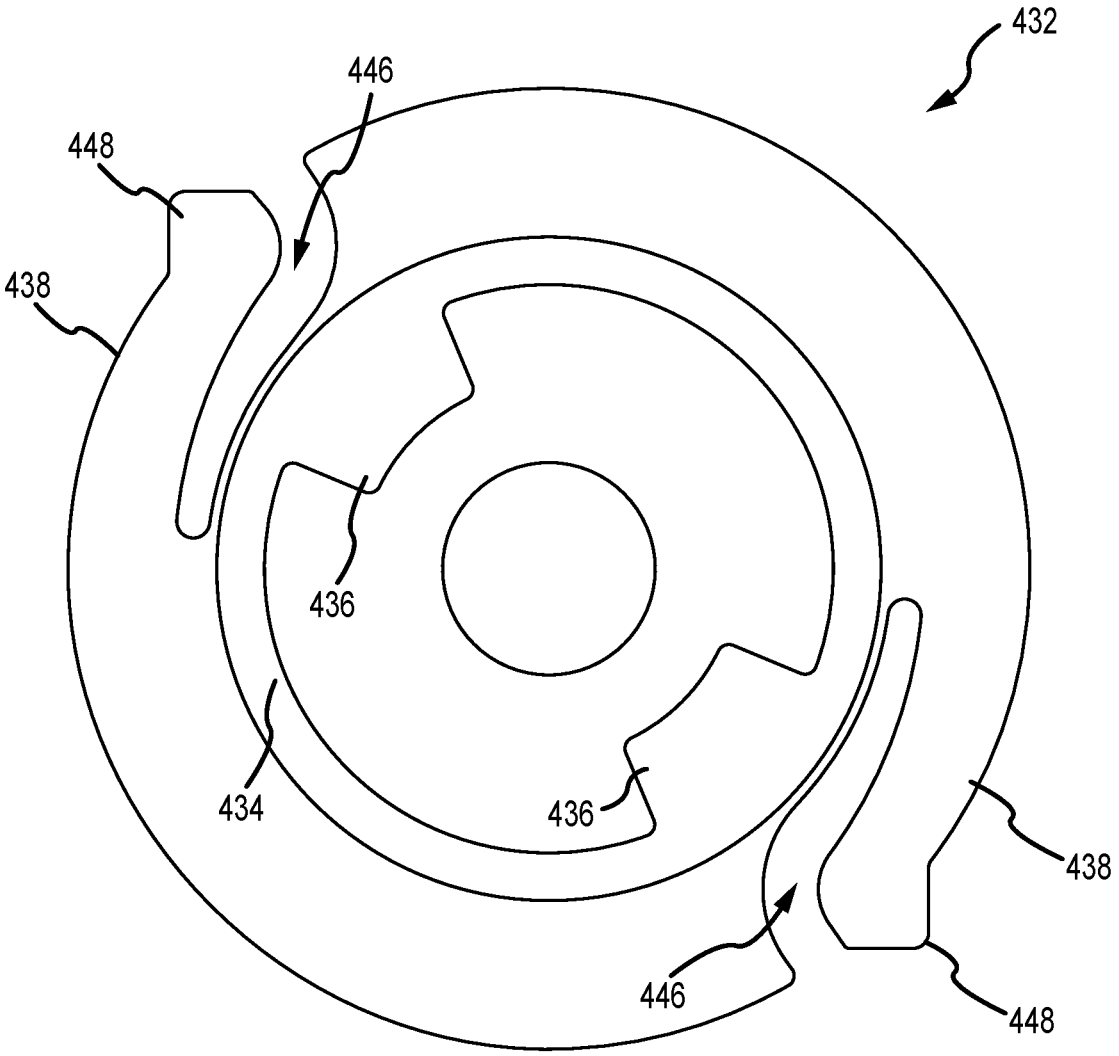
FIG. 9 is a front view of a lost motion disk of the clutch assembly shown in FIG. 8.

FIG. 9 is a front view of the lost motion disk 432 of the clutch assembly 412 (shown in FIG. 8). The spring fingers 438 extend substantially circumferentially along an outer perimeter of the disk 432 and are formed by a slit 446 within the body of the disk 432. The spring fingers 438 can release from, and subsequently recouple to, the clutch disk 430 (shown in FIG. 8) as described above. As such, the spring fingers 438 can move in a substantially radial direction when the biasing force of the spring fingers 438 are overcome (e.g., overcoming the resilient force of the disk material) to decouple the disk 432 from the clutch disk 430. The spring fingers 438 include a radially extending detent 448 that is shaped and sized to be received within the notches 440 of the clutch disk 430 (shown in FIG. 8), and when the detent 448 and the notches 440 are engaged, the rotational movement is transferred between the lost motion disk 432 and the clutch disk 430. In one example, the detent 448 may be formed by two oblique surfaces.

In the example, the spring fingers 438 are circumferentially aligned with the lugs 436 and there are two fingers 438 spaced approximately 180° apart from one another. By aligning the lugs 436 and the fingers 438 the release of the lost motion disk 432 more closely corresponds to the driven motion of the clutch assembly 412. In other examples, the spring fingers 438 may be circumferentially offset from the lugs 436 as required or desired.

The materials utilized in the manufacture of the lock assemblies described herein may be those typically utilized for lock manufacture, e.g., zinc, steel, aluminum, brass, stainless steel, etc. Molded plastics, such as PVC, polyethylene, etc., may be utilized for the various components. Material selection for most of the components may be based on the proposed use of the locking system. Appropriate materials may be selected for mounting systems used on particularly heavy panels, as well as on hinges subject to certain environmental conditions (e.g., moisture, corrosive atmospheres, etc.). Additionally, the lock described herein is suitable for use with doors constructed from vinyl plastic, aluminum, wood, composite, or other door materials.

Any number of features of the different examples described herein may be combined into one single example and alternate examples having fewer than or more than all the features herein described are possible. It is to be understood that terminology employed herein is used for the purpose of describing particular examples only and is not intended to be limiting. It must be noted that, as used in this specification, the singular forms "a," "an," and "the" include plural referents unless the context clearly dictates otherwise.

While there have been described herein what are to be considered exemplary and preferred examples of the present technology, other modifications of the technology will become apparent to those skilled in the art from the teachings herein. The particular methods of manufacture and geometries disclosed herein are exemplary in nature and are not to be considered limiting. It is therefore desired to be secured in the appended claims all such modifications as fall within the spirit and scope of the technology. Accordingly, what is desired to be secured by Letters Patent is the technology as defined and differentiated in the following claims, and all equivalents.

What is claimed is:

1. An electronic drive for a lock assembly comprising:

a housing;

a motor disposed within the housing;

at least one link bar coupled to the motor and at least partially extending out of the housing;

a driven disk coupled to a first end of the at least one link bar and rotatable about a rotational axis, wherein the driven disk is adapted to couple to the lock assembly, and upon rotation, extend and retract at least one locking element, and wherein in operation, the motor selectively drives substantially linear movement of the at least one link bar to rotate the driven disk about the rotational axis;

a clutch assembly coupled to a second end of the at least one link bar and disposed within the housing, wherein the rotational axis is a first rotational axis and the clutch assembly is rotatable about a second rotational axis; and a worm drive coupled between the motor and the clutch assembly, wherein the worm drive is at least partially rotatable independently from the clutch assembly.

2. The electronic drive of claim 1, wherein the housing defines a longitudinal axis, wherein the first rotational axis is parallel to and offset from the second rotational axis, and wherein the first rotational axis and the second rotational axis are both substantially orthogonal to the longitudinal axis.

3. The electronic drive of claim 1, wherein the worm drive is selectively engageable with the clutch assembly.

4. The electronic drive of claim 1, wherein the clutch assembly is at least partially rotatable independently from the worm drive.

5. The electronic drive of claim 1, wherein the clutch assembly comprises two disks coupled together by a tension system.

6. The electronic drive of claim 5, wherein upon exceeding a predetermined load value, the two disks of the clutch assembly are independently rotatable.

7. The electronic drive of claim 1, further comprising a position sensor for determining a relative position of the clutch assembly.

8. The electronic drive of claim 7, wherein the position sensor is a mechanical switch.

9. The electronic drive of claim 1, wherein when the clutch assembly rotates about the second rotational axis, the corresponding rotation of the driven disk is in the same rotational direction.

10. The electronic drive of claim 1, further comprising an access system remote from the housing, wherein the access system controls operation of the motor.

11. A door lock comprising:

a mortise lock assembly comprising one or more locking elements; and an electronic drive coupled to the mortise lock assembly to extend and retract the one or more locking elements, wherein the electronic drive comprises:

a housing;

a motor disposed within the housing;

at least one link bar coupled to the motor and at least partially extending out of the housing;

a driven disk coupled to a first end of the at least one link bar and rotatable about a rotational axis, wherein the driven disk is coupled to the mortise lock assembly, and upon rotation, extend and retract the one or more locking elements, and wherein in operation, the motor selectively drives substantially linear movement of the at least one link bar to rotate the driven disk about the rotational axis;

a clutch assembly coupled to a second end of the at least one link bar and disposed within the housing, wherein the rotational axis is a first rotational axis and the clutch assembly is rotatable about a second rotational axis;

a worm drive coupled between the motor and the clutch assembly, wherein the worm drive is at least partially rotatable independently from the clutch assembly.

12. The door lock of claim 11, further comprising a faceplate, wherein the mortise lock assembly and the housing are both coupled to the faceplate.

13. The door lock of claim 11, further comprising an opening defined within the driven disk.

14. The door lock of claim 11, further comprising an access system operatively coupled to the electronic drive and selectively driving operation of the motor.

15. A method of operating a lock assembly comprising:

receiving at an access system an activation signal from a control element;

detecting, by the access system, a presence of a security device relative to a door;

determining, by the access system, a position of the security device relative to the door;

determining, by the access system, an authorization of the security device;

rotating a driven disk coupled to the lock assembly based on the security device being (i) positioned proximate the door, (ii) located exterior to the door, and (iii) authorized to operate the access system, wherein the driven disk is coupled to a motor that drives rotation of the driven disk, wherein rotating the driven disk comprises rotating a clutch assembly and substantially linearly moving a pair of link bars extending between the driven disk and the clutch assembly; and after rotating the driven disk, positioning a worm drive coupled to the motor in a center neutral position.

* * * * *